US007886391B2

(12) United States Patent
Shikamori et al.

(10) Patent No.: US 7,886,391 B2
(45) Date of Patent: Feb. 15, 2011

(54) TILTED DRUM-TYPE WASHING MACHINE WITH PULSATOR AND METHOD FOR CONTROLLING THE SAME

(75) Inventors: Tamotsu Shikamori, Changwon-si (KR); Dong Beom Lee, Changwon-si (KR); Jong Seog Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1080 days.

(21) Appl. No.: 10/552,962

(22) PCT Filed: Jun. 20, 2005

(86) PCT No.: PCT/KR2005/001909

§ 371 (c)(1),
(2), (4) Date: Dec. 12, 2006

(87) PCT Pub. No.: WO2005/124006

PCT Pub. Date: Dec. 29, 2005

(65) Prior Publication Data

US 2007/0137260 A1 Jun. 21, 2007

(30) Foreign Application Priority Data

Jun. 21, 2004 (KR) ..... 10-2004-0046105
Jun. 21, 2004 (KR) ..... 10-2004-0046106
Jun. 21, 2004 (KR) ..... 10-2004-0046107
Jun. 21, 2004 (KR) ..... 10-2004-0046142

(51) Int. Cl.
*D06F 37/00* (2006.01)
*D06F 35/00* (2006.01)

(52) U.S. Cl. ..... 8/158; 68/3 R; 68/12.24; 68/23 R; 68/24; 68/140

(58) Field of Classification Search ..... 68/3 R, 68/12.06, 12.24, 23.1, 23.2, 23.7, 23 R, 24, 68/140; 8/158, 159
See application file for complete search history.

(56) References Cited

U.S. PATENT DOCUMENTS 2,734,364 A * 2/1956 Dunn et al. ..... 431/150

(Continued)

FOREIGN PATENT DOCUMENTS

CN 1167174 A 12/1997

(Continued)

*Primary Examiner*—Joseph L Perrin
*Assistant Examiner*—Benjamin Osterhout
(74) *Attorney, Agent, or Firm*—McKenna Long & Aldridge LLP

(57) ABSTRACT

The drum type washing machine includes a tub of plastic having a wall portion for holding washing water and securing a driving unit thereto, and a front side sloped upward at a predetermined angle from ground, a drum rotatably mounted in the tub, a hollow drum shaft passed through the tub, and connected to the drum inside of the tub for transmission of driving power from a motor to the drum, at least one bearing for supporting the hollow drum shaft, a stator fixedly secured to the rear wall portion of the tub, a rotor connected to a rear end of the drum shaft to constitute a motor together with the stator, a pulsator rotatably mounted in the drum, a pulsator shaft mounted to pass through the hollow of the drum shaft, having a fore end connected to the pulsator, and pulsator control means for braking/releasing rotation the pulsator.

43 Claims, 12 Drawing Sheets

U.S. PATENT DOCUMENTS

| | | | | |
|---|---|---|---|---|
| 3,373,485 | A * | 3/1968 | Nelsen | 29/598 |
| 5,865,047 | A | 2/1999 | Yoon et al. | |
| 6,176,108 | B1 | 1/2001 | Bae et al. | |
| 6,354,115 | B1 * | 3/2002 | Zahn | 68/23.7 |
| 2003/0046962 | A1 * | 3/2003 | Sonoda et al. | 68/12.06 |
| 2003/0110816 | A1 * | 6/2003 | Chang | 68/53 |
| 2003/0131636 | A1 * | 7/2003 | Lim et al. | 68/23.7 |
| 2004/0163428 | A1 * | 8/2004 | Kim et al. | 68/140 |

FOREIGN PATENT DOCUMENTS

| | | |
|---|---|---|
| EP | 1 386 995 | 2/2004 |
| JP | 2000-342880 A | 12/2000 |
| JP | 2002-315985 A | 10/2002 |

* cited by examiner

TILTED DRUM-TYPE WASHING MACHINE WITH PULSATOR AND METHOD FOR CONTROLLING THE SAME

This application claims priority to International Application No. PCT/KR2005/001909 filed on Jun. 20, 2005, as well as Korean Applications P 2004-46105 filed on Jun. 21, 2004, P 2004-46106 filed on Jun. 21, 2004, P 2004-46107 filed on Jun. 21, 2004, and P 2004-46142 filed Jun. 21, 2004, all of which are incorporated by reference, as if fully set forth herein.

TECHNICAL FIELD

The present invention relates to drum type washing machines, and more particularly, to a drum type washing machine of a new structure, in which a structure of the drum type washing machine is improved, to make introduction and take out of laundry easy, and to enhance a washing performance.

BACKGROUND ART

In general, the washing machine is a home appliance for removing dirt from laundry by chemical decomposition of detergent and mechanical impact of water circulation.

Of the washing machines, since the drum type washing machine permits, not only to reduce a total height compared to a pulsator type washing machine having an upstanding cylindrical inner tub rotatably mounted therein, but also to increase a washing capacity more compared to a same size of the pulsator type washing machine, and cause no problem of entangling of laundry while reducing washing water consumption, it is a trend that demands for the drum type washing machine increases more and more.

A related art drum type washing machine will be described in detail, with reference to the attached drawings.

FIG. 1 illustrates a section of a related art drum type washing machine, provided with a tub 2 suspended with dampers and springs in a cabinet 1, a cylindrical drum 3 rotatably mounted in the tub 2, and a driving unit coupled to the drum 3 with a shaft.

The driving unit provided to a rear of the tub 2 with a rotor 4 and a stator 5, wherein a rotor shaft 6 rotatable with the drum 3 is directly coupled to the rotor 4 for transmission of a driving power from the rotor to the drum 3 directly without a pulley or a belt.

On a front of the cabinet 1, there is a door 10 on an opening of the drum, and between the door 10 and the drum 3, there is a gasket 20 for sealing.

Upon application of power to the drum type washing machine, the rotor 4 rotates by electromagnetic interaction with the stator 5, to transmit rotation force thereof to the drum 3 through the rotor shaft 6.

In this instance, the washing is made by an impact of drop of the laundry lifted by a lifter 3*a* as the drum 3 rotates.

However, the related art drum type washing machine has a problem in that introduction/taking out laundry into/from drum 3 is not convenient since the user is required to squat or bend as the door 10 is at a center of the front of the cabinet 1, and the drum 3 is mounted horizontally.

Moreover, the washing made only relying on rotation of the drum can not provide a good washing performance.

That is, since the related art drum type washing machine makes washing by a simple method of lifting and dropping laundry with the lifters, the related art drum type washing machine has a limit in enhancing a washing performance.

Meanwhile, even a related art drum type washing and drying machine also has the same problem.

DISCLOSURE

Technical Problem

An object of the present invention is to provide a tilted drum type washing machine of a new structure, which can make introduction and take out of laundry easy, reduce water consumption, and enhance washing performance, and effect, and a method for controlling the same.

TECHNICAL SOLUTION

The object of the present invention can be achieved by providing The drum type washing machine includes a tub of plastic having a wall portion for holding washing water and securing a driving unit thereto, and a front side sloped upward at a predetermined angle from ground, a drum rotatably mounted in the tub, a hollow drum shaft passed through the tub, and connected to the drum inside of the tub for transmission of driving power from a motor to the drum, at least one bearing for supporting the hollow drum shaft, a stator fixedly secured to the rear wall portion of the tub, a rotor connected to a rear end of the drum shaft to constitute a motor together with the stator, a pulsator rotatably mounted in the drum, a pulsator shaft mounted to pass through the hollow of the drum shaft, having a fore end connected to the pulsator, and pulsator control means for braking/releasing rotation of the rotation of the pulsator.

In another aspect of the present invention, a method for controlling a tilted drum type washing machine, in which rotation of a pulsator in a drum is controlled by braking/releasing a pulsator rotation control pulley, the tilted drum type washing machine comprising a tub of plastic having a wall portion for holding washing water and securing a driving unit thereto, and a front side sloped upward at a predetermined angle from ground, a drum rotatably mounted in the tub, lifters on an inside circumferential surface of the drum, a hollow drum shaft passed through the tub, and connected to the drum inside of the tub for transmission of driving power from a motor to the drum, at least one bearing for supporting the hollow drum shaft, a sleeve shaped bearing housing for supporting the bearing, a stator fixedly secured to the rear wall portion of the tub, a rotor bushing of an insulating material secured to a rear end of the drum shaft, a rotor secured to the rotor bushing for transmission of driving force to the drum shaft through the rotor bushing, a rotor secured to a rear end of the drum shaft to constitute a BLDC motor together with the stator, a pulsator rotatably mounted on an inside of the drum, having curved shape of washing fins on a main surface thereof, a pulsator shaft mounted to pass through the hollow of the drum shaft, having a fore end connected to the pulsator, a pulley positioned in rear of the rotor, and coupled to a rear end of the pulsator shaft, for controlling rotation of the pulsator, and a braking device including a solenoid secured to the tub, a plunger moving back and forth in the solenoid, so that the plunger brakes or releases the pulley depending on electric turn on/off of the solenoid, for braking/releasing rotation of the pulsator, the method comprising the steps of performing washing in a state the pulsator is held, and performing washing in a state the pulsator is released to rotate freely.

In the meantime, in another aspect of the present invention, a drum type washing machine includes a tub of plastic having a wall portion for holding washing water and securing a driving unit thereto, a front side sloped upward at a predetermined angle from ground, a hot air inlet in an upper side of a rear wall, and a hot air outlet in a lower side of a front, a drum rotatably mounted in the tub, having hot air pass through holes in a rear wall, a hollow drum shaft passed through the tub, and connected to the drum inside of the tub for transmission of driving power from a motor to the drum, at least one bearing for supporting the hollow drum shaft, a sleeve shaped bearing housing for supporting the bearing, a stator fixedly secured to the rear wall portion of the tub, a rotor connected to a rear end of the drum shaft to constitute a motor together with the stator, a pulsator rotatably mounted in the drum, having hot air supply holes in a main surface thereof, a pulsator shaft mounted to pass through the hollow of the drum shaft, having a fore end connected to the pulsator, pulsator control means for braking/releasing rotation of the rotation of the pulsator, and hot air supply means for supplying hot air into the drum to dry the laundry in the drum.

ADVANTAGEOUS EFFECTS

As has been described, the drum type washing machine in accordance with first, or second preferred embodiment of the present invention can improves product reliability of the user as the tilted tub enables easy introduction and taking out of the laundry, and to reduce consumption of water in washing.

Particularly, the rotation of the drum in a tilted state, and the provision of pulsator inside of the drum vary movement of the laundry and water circulation within the drum, which improves a washing performance.

That is, the positional change of the laundry caused by the sloped surface of the washing fins and the slope of the main surface of the pulsator makes back and forth movements of the laundry more active than the related art in which the laundry is merely lifted up by the lifters and dropped, to vary the movements of the laundry, and the water circulation, which improves a washing performance.

Moreover, the application of a new drying system in which hot air is center blown along an axis of the drum permits the air to penetrate deep into an inside of the drum, to improve a drying efficiency, and a drying performance.

The connection of the drying duct to the tub, making the gasket arranged in an exact symmetry permits uniform absorption of vibration of the tub, and, different from the related art, resolves the problem of unnecessary heating of the door.

The drying duct also serving as a balance weight improves a balance sustaining capability of the tub.

In the meantime, along with the improvement of the washing and drying performance, the provision of auto-balancers to a front and a rear of the drum for maintaining balance of the drum by means of fluid in addition to the balance weights mounted on the tub permits effective reduction of system vibration caused by en eccentric load in the drum during spinning.

BEST MODE

Preferred embodiments of the present invention will be described in more detail with reference to FIGS. 2 to 12.

A first preferred embodiment of the present invention will be described with reference to FIGS. 2 to 8.

Figure 1:
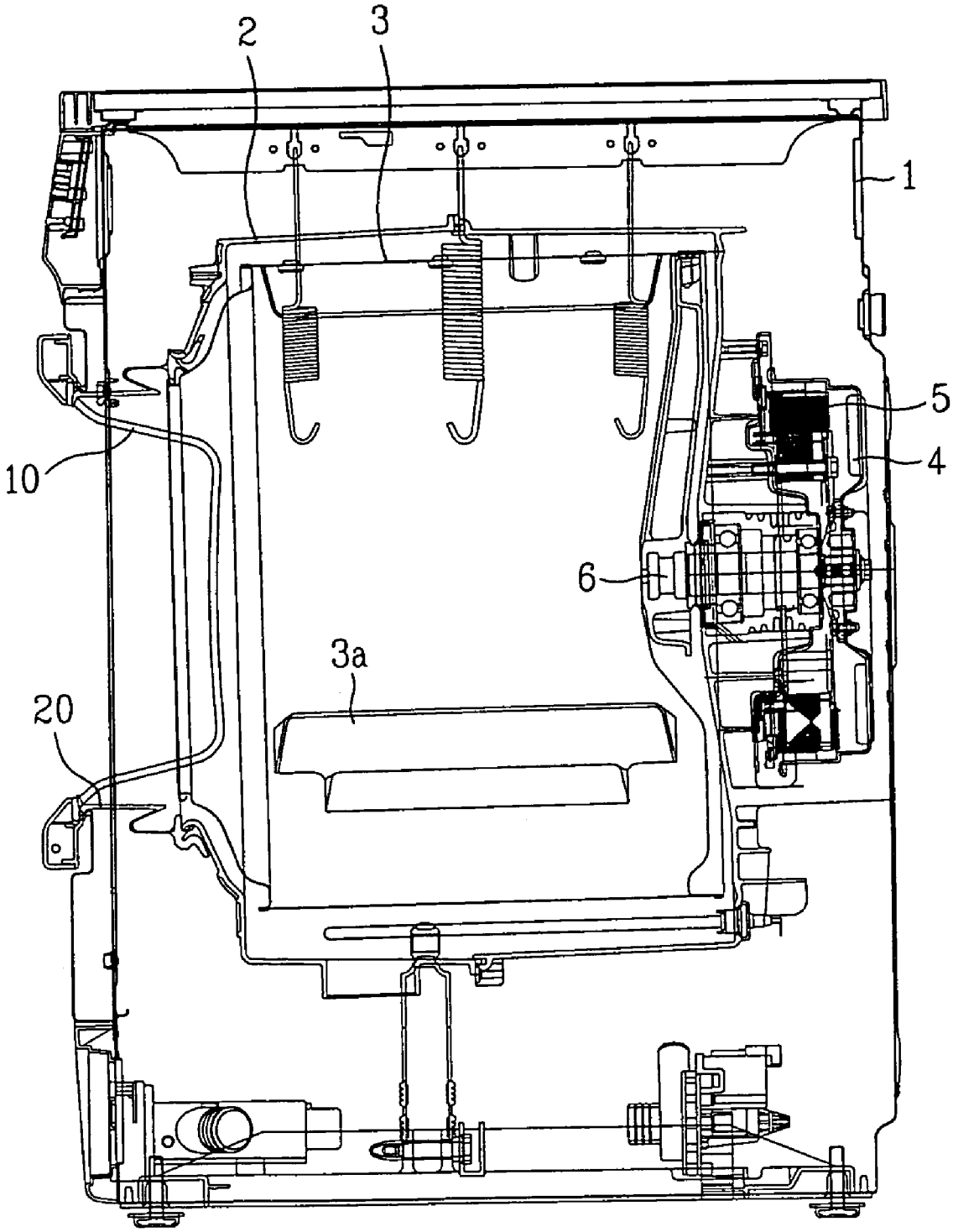
FIG. 1 illustrates a section of a related art drum type washing machine.
Figure 2:
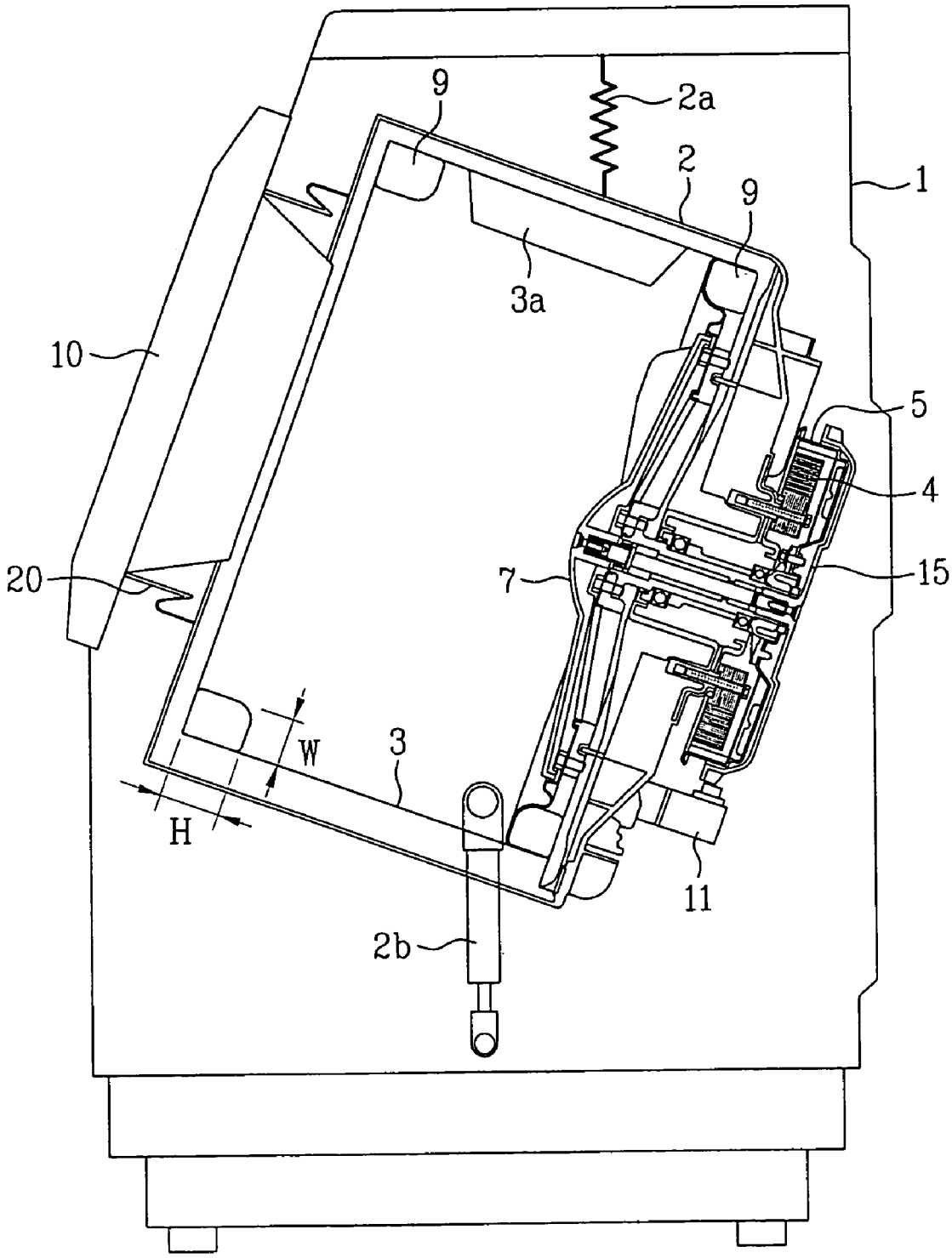
FIG. 2 illustrates a longitudinal section of a drum type washing machine in accordance with a first preferred embodiment of the present invention, schematically.
Figure 3:
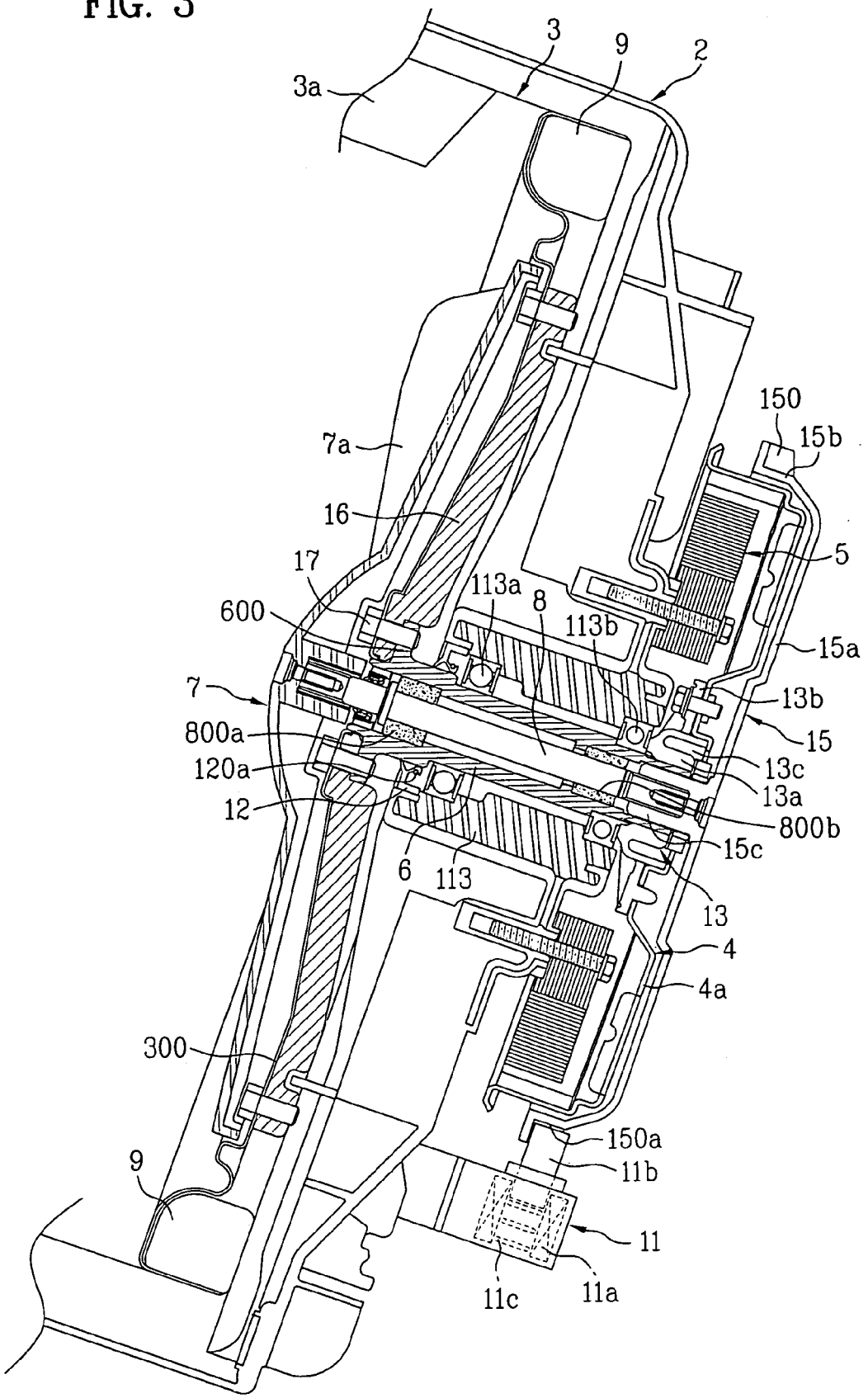
FIG. 3 illustrates a key part section, an enlarged view of the "A" part in FIG. 2, showing a pulsator in stationary.
Figure 4:
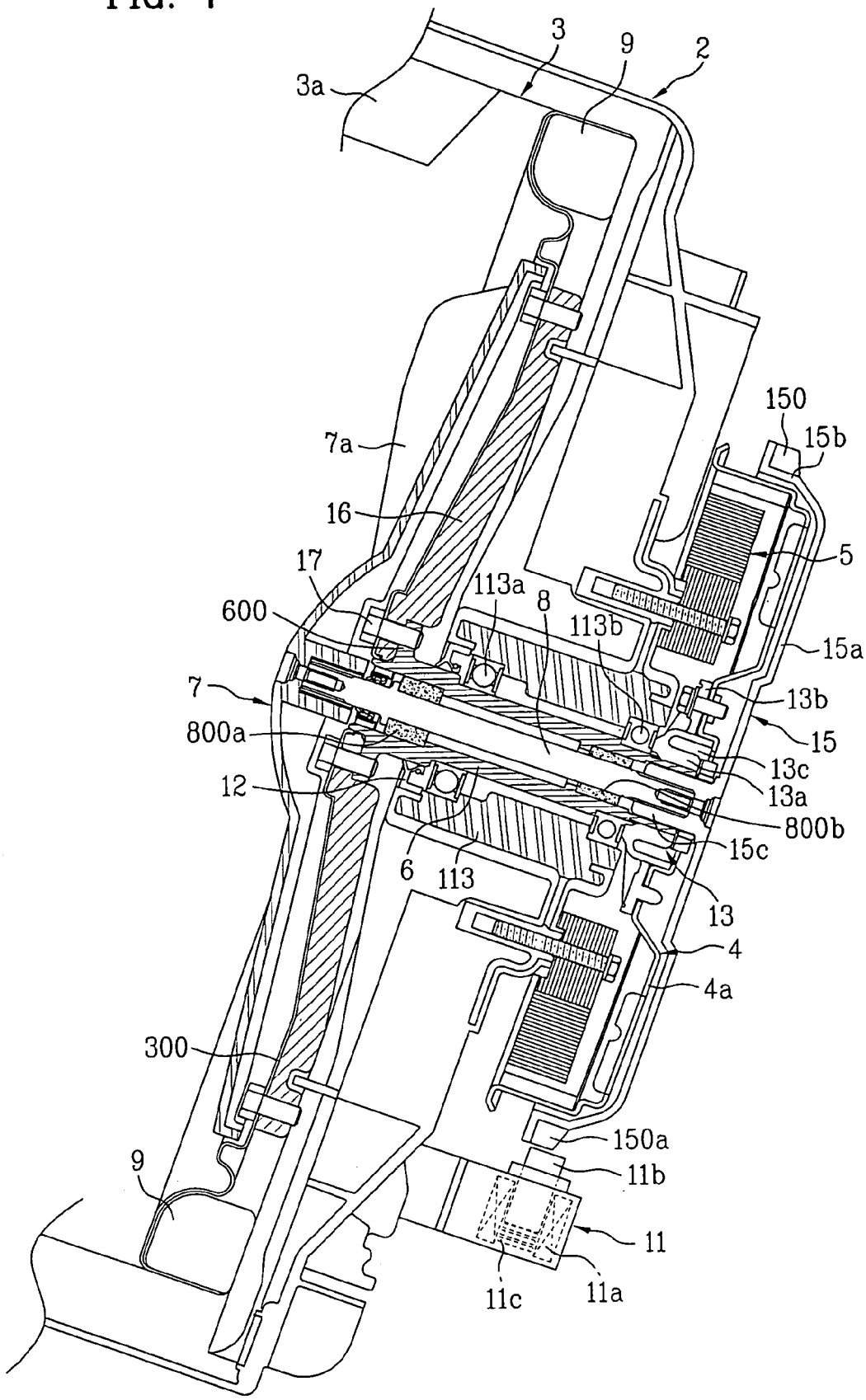
FIG. 4 illustrates a key part section, an enlarged view of the "A" part in FIG. 2, showing a pulsator in rotation.

FIG. 2 illustrates a longitudinal section of a drum type washing machine in accordance with a first preferred embodiment of the present invention schematically, FIG. 3 illustrates a key part section, an enlarged view of the "A" part in FIG. 2, showing a pulsator in stationary, and FIG. 4 illustrates a key part section, an enlarged view of the "A" part in FIG. 2, showing a pulsator in rotation.

Figure 5:
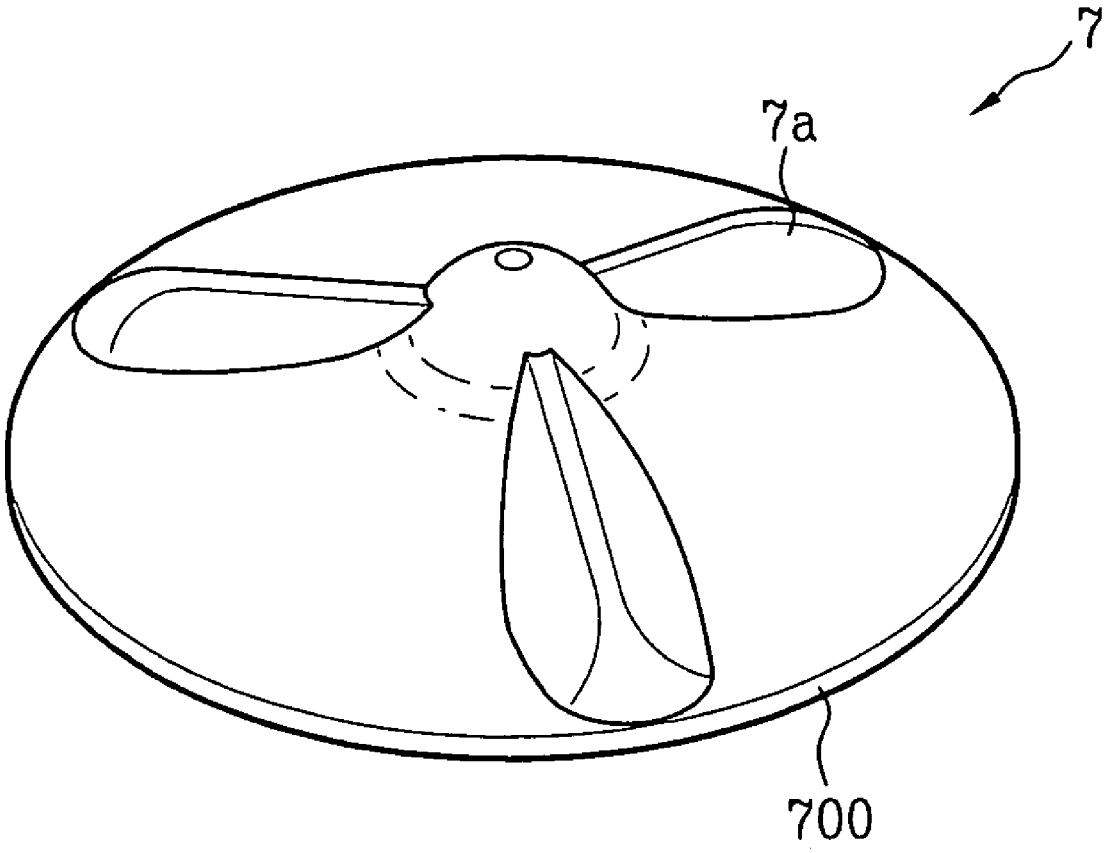
FIG. 5 illustrates a perspective view of the pulsator in FIG. 2.
Figure 6:
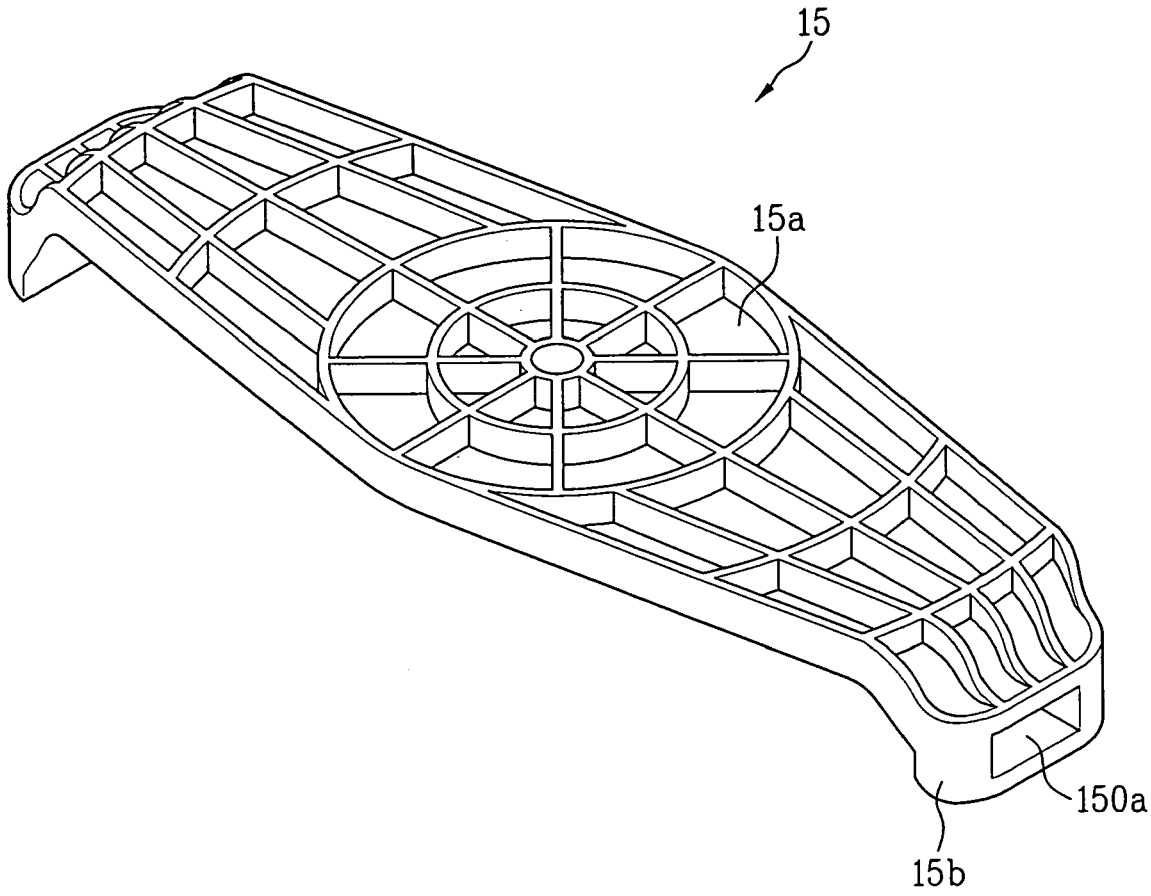
FIG. 6 illustrates a perspective view showing a pulsator rotation control pulley of the present invention as an example.
Figure 7:
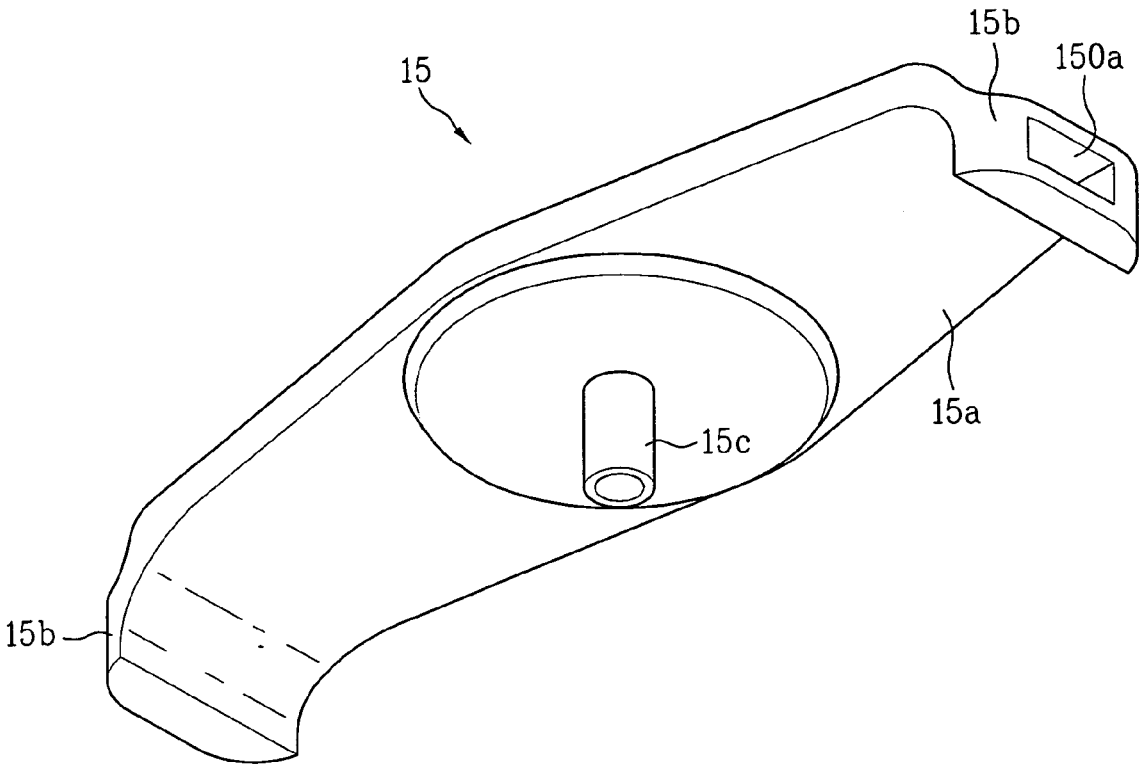
FIG. 7 illustrates a perspective view of a back side of FIG. 6.
Figure 8:
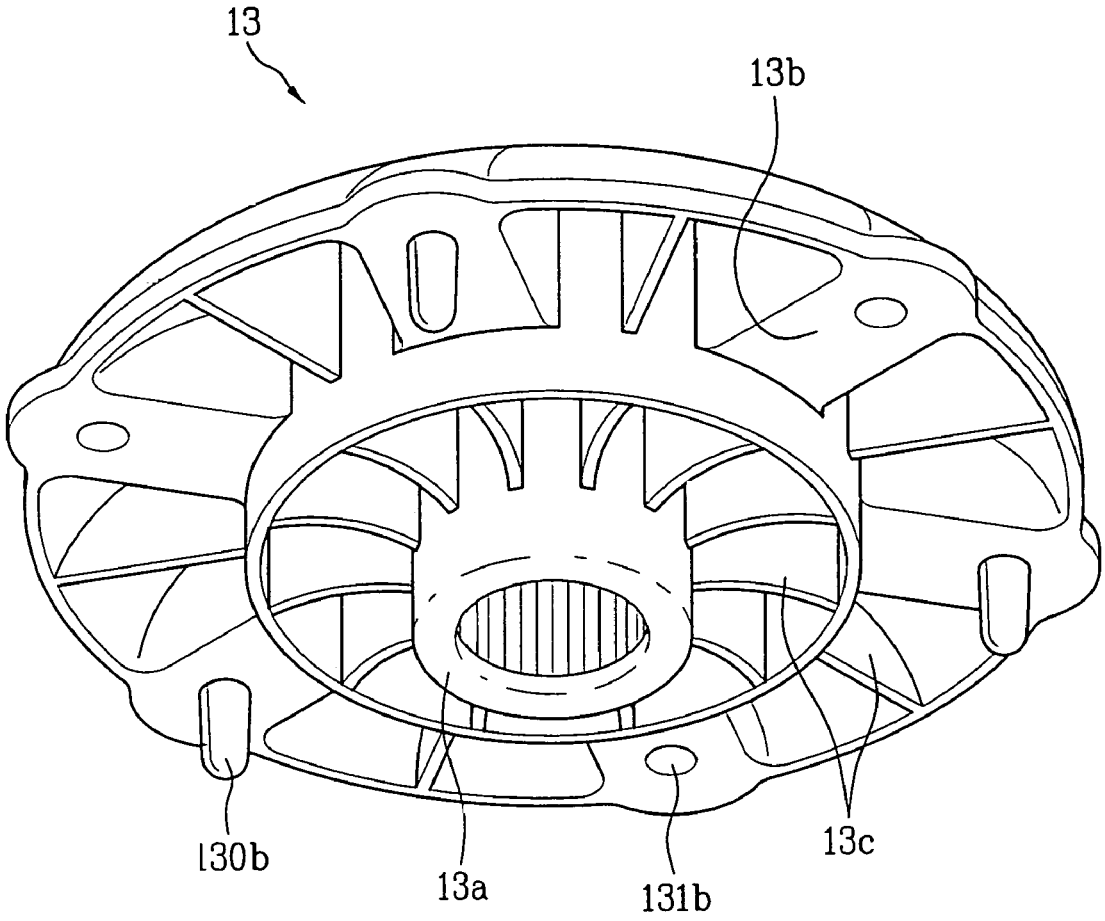
FIG. 8 illustrates a perspective view of a rotor bushing in FIG. 3 or 4.

FIG. 5 illustrates a perspective view of the pulsator in FIG. 2, FIG. 6 illustrates a perspective view showing a pulsator rotation control pulley of the present invention as an example, FIG. 7 illustrates a perspective view of a back side of FIG. 6, and FIG. 8 illustrates a perspective view of a rotor bushing in FIG. 3 or 4.

Referring to FIGS. 2 to 8, the drum type washing machine includes a tub 2 of plastic having a wall portion for holding washing water and securing a driving unit thereto, and a front side sloped upward at a predetermined angle from ground, a drum 3 rotatably mounted in the tub 2, a hollow drum shaft 6 passed through the tub 2, and connected to the drum 3 inside of the tub 2 for transmission of driving power from a motor to the drum, bearings 113*a*, and 113*b* for supporting the hollow drum shaft 6, a bearing housing 113 of a sleeve shape for holding the bearings 113*a* and 113*b*, a stator 5 fixedly secured to the rear wall portion of the tub 2, a rotor 4 connected to a rear end of the drum shaft 6 to constitute a BLDC motor together with the stator 5, a pulsator 7 rotatably mounted in the drum 3, a pulsator shaft 8 mounted to pass through the hollow of the drum shaft 6, having a fore end connected to the pulsator 7, and pulsator control means for braking/releasing rotation of the rotation of the pulsator.

The pulsator control means includes a pulley 15 in rear of the rotor 4 connected to a rear end of the pulsator shaft 8, for controlling rotation of the pulsator, and a braking device 11 for controlling rotation of the pulsator 7 in the drum 3 by braking/releasing the pulley 15.

At a center of a rear side of the tub 2, there is the bearing housing 113 insert molded thereto as one unit therewith, having the front and rear bearings 113*a*, and 113*b* press fit therein for supporting the drum shaft 6 at a rear side of the drum 3.

The stator 5 is fastened to the rear wall of the tub 2 with fastening members, such as bolts.

In the meantime, the pulsator shaft 8 is supported on oiless bearings 800*a*, and 800*b* mounted on a front and a rear of the shaft 8, respectively.

Though it is preferable that the bearings 113*a* and 113*b*, supporting the hollow drum shaft 6, are mounted on a front side and a rear side of the shaft respectively for secure supporting of the shaft, there is no limit in a number of bearings.

In this instance, mounting the bearings 113*a* and 113*b* far from each other on the front side and rear side of the drum shaft 6 is favorable for secure supporting of the shaft.

It is favorable that, of the bearings 113*a* and 113*b* supporting the hollow drum shaft 6, the front side bearing 113*a* of the drum shaft 6 has a diameter grater than a diameter of the rear side bearing 113*b* for minimizing vibration of the drum 3 during spinning, and making strength higher.

In front of the front side bearing 113*a* of the drum shaft 6, there is a water seal 12 for preventing water leakage, having a spring 120*a* therein for pressing the water seal 12 toward an outside circumferential surface of the drum shaft 6.

An outside of the water seal 12 is supported either on the bearing housing 113, or a shape of the rear wall of the tub as shown in FIGS. 3 and 4.

The braking device 11 includes a solenoid 11*a* secured to the tub 2, and a plunger 11*b* moving back and forth in the solenoid 11*a*, so that the plunger 11*b* brakes or releases the pulley 15 depending on electric turn on/off of the solenoid 11*a*, for braking/releasing rotation of the pulsator 7.

It is preferable that an elastic member, such as a compression spring 11*c*, is mounted in the solenoid 11*a*.

This is for the plunger 11*b* to be lead to a position of the holding recess 150*a* in the pulley 15 automatically after a moment even if the plunger 11*b* moves backward by elasticity, taking a chance the pulley 15 coupled to the pulsator 7 rotates owing to engagement based on friction of laundry in the drum following rotation of the drum 3, even if the holding recess 150*a* in the pulley 15 is not aligned with the plunger 11*b* at the time the plunger 11*b* moves forward for braking the pulsator 7, but comes into contact with an outside surface of a sidewall 15*b* of the pulley 11*b* spaced away from the holding recess 150*a*.

Different from above example in which the solenoid 11*a* is secured to the tub 2, the braking device of the solenoid 11*a* may be secured, not to the tub 2, but to other place, such as the cabinet 1, with the compression spring 11*c* and the plunger 11*b* provided therein, so that the back and forth movement of the plunger 11*b* following electric turn on/off of the solenoid 11*a* brakes/releases the pulley 15, thereby controlling braking/releasing rotation of the pulsator 7.

In the meantime, between the drum shaft 6 and the rotor 4, there is a rotor bushing 13 of plastic for coupling to the drum shaft 6 and the rotor frame 4*a* in a state the rotor bushing 13 is positioned in rear, or front of a rotor frame 4*a*.

The rotor bushing 13 includes an engagement portion 13*a* for placing in, and engagement with the drum shaft 6 at a center thereof, and a coupling portion 13*b* extended in a radial direction from a circumference of the engagement portion 13*a* for coupling with the rotor frame 4*a*.

It is preferable that the coupling portion 13*b* of the rotor bushing 13 includes a plurality of positioning projections formed as one body therewith and projected toward the rotor frame 4*a*, or a plurality of fastening holes 131*b* for fastening to the rotor frame 4*a* with bolts.

It is preferable that reinforcing ribs 13*c* are provided further at least one of the engagement portion 13*a* and the coupling portion 13*b* of the rotor busing 13 for reinforcement.

There are serration formed on an outside circumferential surface of a rear end portion of the drum shaft 6, and on an inside circumferential surface of a center of the engagement portion 13*a* of the rotor bushing opposite thereto, for engagement with each other.

In the meantime, on an outer side of the rear wall of the drum 3, there is a spider 16 secured thereto for supporting the rear wall 300 of the drum and reinforcing the strength, and at a front end portion of the drum shaft 6, there is a flange 600 in close contact with the spider 16, for fastening the drum rear wall 300, the spider 16, and the flange 600 of the drum shaft 6 with fastening members 17 passed therethrough, together.

The pulsator shaft 8 has serrations on opposite end portion for engagement with the pulsator 7 and the pulley 15, preferably each with an involute profile surface.

The pulley 15 includes a rear wall portion 15*a* covering the rear wall of the rotor frame 4*a*, a sidewall portion 15*b* for covering a sidewall of the rotor frame 4*a* of steel fabricated by pressing, an engagement portion 15*c* at a center of the rear wall portion 15*a* for engagement with the pulsator shaft 8, and the holding recess 150*a* in the pulley 15 at a portion covering the rotor frame 4*a* for being held by the braking device 11.

The engagement portion 15*c* of the pulley 15 has a boss shape projected from the pulley 15 such that the engagement portion 15*c* is positioned on an inside of a rear end of the drum shaft 6 at the time of assembly of the pulley 15 in an assembly line.

The drum shaft 6 is formed of an SM 45 group of material, or stainless steel, wherein if the drum shaft 6 is formed of an SM 45 group of material, a surface of the drum shaft 6 is plated with chrome Cr for reducing wear, and friction, and enhancing corrosion resistance. In this instance, the surface of the drum shaft 6 is plated with chrome Cr, entirely, or partially for reduction of cost. In this case, of the surface of the drum shaft 6, it is required to plate a sliding surface of the water seal 12 without fail.

In the meantime, it is favorable that the drum shaft 6 is formed of stainless steel even if it costs somewhat more, for reducing wear/friction of the slide surfaces of the water seal 12 and drum shaft 6 and securing corrosion resistance of the drum shaft 6, positively.

On a surface of the pulsator 7, there are washing fins 7*a* for increasing friction of the laundry by making the laundry, lifted up by the rotation of the drum 3 and fallen down, to hit the washing fins 7*a*, and moving the laundry back and forth within the drum 3.

In this instance, though it is preferable that a main surface (i.e., a surface) of the pulsator 7 and the washing fins 7*a* provided at regular intervals thereon are formed as one body, it is not necessarily so.

In the meantime, the washing fin 7*a* has at least one sloped surface in a radial, or circumferential direction.

The main surface of the pulsator 7 has a predetermined curvature, and an outside diameter around 50~80% of the inside diameter of the drum 3.

A maximum height 7*a* of the washing fin 7*a* of the pulsator 7 is 5~15% of the outside diameter of the pulsator.

Moreover, it is preferable that the drum 3 and the tub 2 are mounted such that axes thereof are tilted at 10~30° to ground, for convenience of introduction/taking out of laundry, and enhancing a washing effect. Also, the tilted angle of 10~30° range can prevent occurrence of excessive vibration.

If the tilted angle exceeds 30°, to make the drum 3 to rotate in a state tilted much, leading the laundry leaned on a rear side of the drum 3, a washing performance drops and an excessive vibration occurs in spinning due to entangling of the laundry.

Accordingly, taking this into account, it is preferable that the tilting angle of the tub 2 is below 30°.

In the meantime, the drum 3 has a plurality of lifters 3*a* on an inside circumferential surface for lifting up the laundry. There is a distance 'D' of approx. 30~90 mm between the lifter 3*a* and the washing fin of the pulsator 7, more preferably, in a range of 60 mm, for preventing the laundry from being held between the lifter 3*a* and the pulsator 7 to hold rotation of the pulsator 7 and the drum 3.

In the meantime, it is preferable that auto-balancers 9 each filled with liquid, such as water, or salt water, are mounted on an inside and/or outside of a front, and a rear of the drum 3, for reducing vibration in spinning.

For an example, the auto-balancers 9 may be mounted on the inside of the front and the outside of the rear of the drum 3, or the inside of the front and the rear of the drum 3.

Moreover, the auto-balancer 9 may have a single fluid chamber, or more favorably, double, triple, or quadruple fluid chambers on concentric circles, separated between inner and outer fluid chambers, for preventing the fluid from moving between the fluid chambers.

It is favorable that the auto-balancer 9 has a height 'H' greater than a width 'W' for reducing vibration of the drum 3.

In the meantime, together with above, of course, between an inside surface of an upper surface of the cabinet 1 and an outside circumferential surface of an upper side of the tub 2, there may be hanging springs 2*a* for suspending the tub 2, and, between a lower side of an outside circumference of the tub 2 and a bottom surface of the cabinet 1, there may be dampers for damping vibration of the tub 2 in spinning.

The operation of the drum type washing machine of the present invention will be described.

The 10~30 degrees of tilting of the drum 3 and the tub 2 with reference to front sides ground thereof enables convenient introduction, and taking out of laundry.

That is, when it is intended to introduce or take out laundry into/from the drum 3, different from the related art drum type washing machine in which the user is required to stretch one hand in a state the user squats or bends, the drum type washing machine of the present invention enables easy handling of the laundry at the time of introduction or taking out laundry into/from the drum 3, owing to the tilted tub 2 and the drum 3.

Along with such convenience, the drum type washing machine of the present invention can improve the washing performance owing to the pulsator 7 mounted inside of the drum 3.

That is, though the related art drum type washing machine has a limitation in enhancing the washing performance since the washing is achieved only by lifting up and dropping down of the laundry with the lifters 3*a*, the drum type washing machine of the present invention can improve the washing performance significantly because the drum type washing machine of the present invention has the pulsator 7 mounted therein in addition to the tilted tub 2 and drum 3, to add impact between the pulsator 7 and the laundry to the action of the lifters 3*a*, and make the back and forth movement of the laundry more active owing to the tilting of the drum 3 and the shape of the pulsator 7.

In more detail, in a state the tub 2 and the drum 3 are tilted, and the pulsator shaft 8 is passed through the hollow drum shaft 6 and connected to the pulley 15 in rear of the motor, as the plunger 11*b* is placed in (see FIG. 3), or moved away from (see FIG. 4), the holding recess 150*a* in the pulley 150*a* by the action of the solenoid 11*a* and the compression spring 11*c* of the braking device 11 fixedly secured to the rear wall of the tub 2 or the like following control of power applied to the braking device, the pulley 15 is held or released. This holding or releasing of the pulley 15 implies that the pulsator 7 is held of freed.

According to this, as the pulsator 7 is held or freed to be rotatable in washing, varying movement of the laundry in the drum 3, the washing performance can be improved.

In the meantime, in spinning too, the plunger 11*b* may be placed in the holding recess 150*a* of the pulley 15, to hold the pulsator 7, or the plunger 11*b* may be moved away from the holding recess 150*a* of the pulley 15, to leave the pulsator 7 rotatable.

In the spinning, if the solenoid 11*a* is turned on to make the plunger 11*b* to move away from the holding recess 150*a* of the pulley 15, to leave the pulsator 7 to spin too if the drum 3 spins, the spinning of the pulsator 7 in this time is not a forced rotation like the drum by the direct driving force. That is, the pulsator 7 is rotated, not synchronized with a motor speed, but at a speed almost the same with the drum 3 as a rotation force of the drum is transmitted to the pulsator 7 owing to the laundry in the drum 3 placed on the pulsator 7.

In the meantime, along with the improvement of the washing performance, the drum type washing machine of the present invention can reduce system vibration caused by an eccentric load in the drum 3 effectively in spinning by providing the auto-balancers 9 to the front and the rear of the drum 3 for balancing the drum by means of fluid separate from balance weights mounted on the tub 2.

Particularly, though the drum type washing machine of the present invention is liable to have greater vibration at a rear side than the related art due to the tilted tub 2 and the drum 3, the attachment of the auto-balancers 9 to the inside or outside of rear of the drum 3 enables effective reduction of vibration of the rear side.

Moreover, as described before, the tilted tub 2 also requires the drum 3 in the tub 2 to be tilted, to consume less washing water filled in the drum 3 in washing.

For an example, owing to the tilted drum 3, washing water leans on a rear side of the drum 3 partially, and to carry out the washing after filling the washing water only just to put the laundry gathered on the rear side under the washing water.

In the meantime, the placement of the engagement portion 15*c* of the pulley 15 in the drum shaft 6 in assembly of the pulley 15 shortens a total length of the drum type washing machine.

That is, if the engagement portion 15*c* of the pulley 15 can not be placed in the drum shaft 6 in a tilted state, though the total length becomes longer, to reduce the capacity of the drum type washing machine, the placement of the engagement portion 15*c* of the pulley 15 in the drum shaft 6 enables to reduce the total length, leading to increase the washing capacity, relatively.

In the meantime, a control process and operation of the pulley 15 will be described in washing of the drum type washing machine in accordance with the first preferred embodiment of the present invention.

A process for washing by rotating the drum 3 in a state the pulsator 7 is stationary will be described with reference to FIG. 3.

Referring to FIG. 3, if the plunger 11*b* moves forward to position in the holding recess 150*a* of the pulley 15, the pulley 15 can rotate no more, to hold the pulsator 7 in the drum 3 too.

In this state, if power is applied for washing, the rotor 4 rotates by electro-magnetic interaction with the stator 5, to rotate the drum 3 coupled to the rotor 4 with a shaft.

In this instance, the drum 3 may rotate in left/right directions alternately under the control of a microcomputer (not shown), and the pulsator 7 is stationary.

According to this, the washing is performed as the laundry is lifted by the plurality of lifters 3*a* in the drum 3 and dropped by gravity, when a portion of the laundry hits the pulsator 7 and the washing fin 7*a* to move forward because the drum 3 is tilted.

Particularly, the washing machine of the present invention has a greater back and forth movement of the laundry dropped after lifted up by the lifters 3*a* than the related art owing to the central projection of the washing fins 7*a* and the pulsator 7. That is, the sloped surface of the washing fins 7*a*, the main surface curvature of the pulsator 7, and the tilted angle, and so on cause positional change of the laundry.

Moreover, since the drum 3 rotates in a tilted state, and the pulsator 7 is stationary, a speed difference between the rotating drum 3 and the stationary pulsator 7 causes irregular and various forms of laundry movement and circulation of the washing water.

In this instance, the washing water circulation spreads the laundry gathered on a rear side of the drum 3 to various directions again, to help uniform washing of the laundry.

That is, in washing, the water circulation caused by collision between the washing water and the pulsator 7, and impact between the laundry and the pulsator improves a washing capability and rinsing capability of the laundry, substantially.

Different from above, a washing in a state the pulsator 7 is rotatable as the braking on the pulley 15 is released will be described with reference to FIG. 4.

Referring to FIG. 4, if power is applied to the solenoid 11*a* to move the plunger 11*b* backward, while compressing the compression spring 11*c*, the plunger 11*b* moves away from the holding recess 150*a* of the pulley 15, leaving the pulley 15, as well as the pulsator 7 rotatable.

Under this state, if power is applied for washing, the rotor rotates by the electro-magnetic interaction with the stator 5, to rotate the drum 3 coupled to the rotor 4 with a shaft.

In this instance, as described before, the drum 3 can rotate in left/right directions alternately at predetermined intervals, and the pulsator 7 rotates in a left, or right direction under the interference of the laundry and the washing water circulating in the drum when the drum 3 rotates.

Accordingly, in washing the laundry by lifting the laundry with a plurality of lifters 3*a* on an inside of the drum 3 and dropping the laundry by gravity, since the drum 3 is tilted, a portion of the laundry collides onto the rotating pulsator 7.

The laundry 7 collided onto the pulsator 7 moves forward.

That is, alike a previous description, in this case too, the drum type washing machine of the present invention causes a positional change of the laundry owing to the sloped surface of the washing fin 7*a*, the main surface curvature of the pulsator 7, and the tilted angle, to increase back and forth movement of the laundry compared to the related art in which the laundry is simply lifted up by the lifters 3*a* and dropped.

Along with this, because the pulsator 7 rotates not forcibly at a fixed speed though the pulsator 7 is in a rotatable state, there is a speed difference between the drum 3 and the pulsator 7, to cause irregular and various forms laundry movement and washing water circulation in this time too.

That is, even if the relative speed difference is small compared to the state the pulsator 7 is stationary, there is a relative speed difference between the drum 3 and the pulsator 7, which helps the movement of the laundry, that contributes to improvement of the washing capability and the rinsing capability.

In short, the drum type washing machine of the present invention can perform washing by using a relatively great speed difference in a state the pulsator 7 is held to be stationary, or by using a relatively small speed difference in a state the pulsator 7 is released to rotate freely.

Moreover, in washing, the washing may be performed by controlling the alternating time period of the drum 3 to be short in which the laundry does not drop in a state the pulsator 7 is held or released.

A second preferred embodiment of the present invention will be described in more detail with reference to FIGS. 9 to 12.

Figure 9:
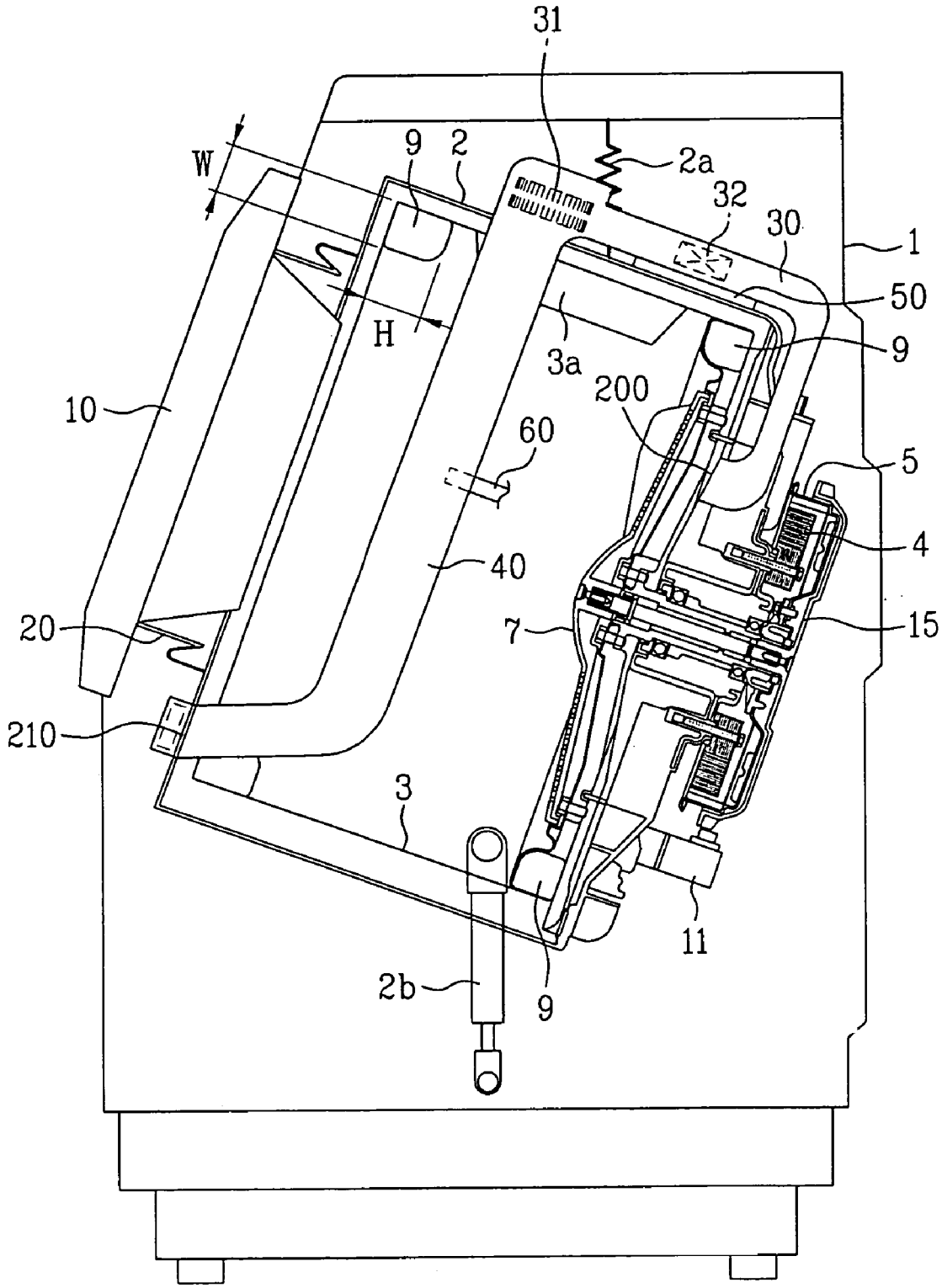
FIG. 9 illustrates a longitudinal section of a drum type washing machine in accordance with a second preferred embodiment of the present invention, schematically.
Figure 10:
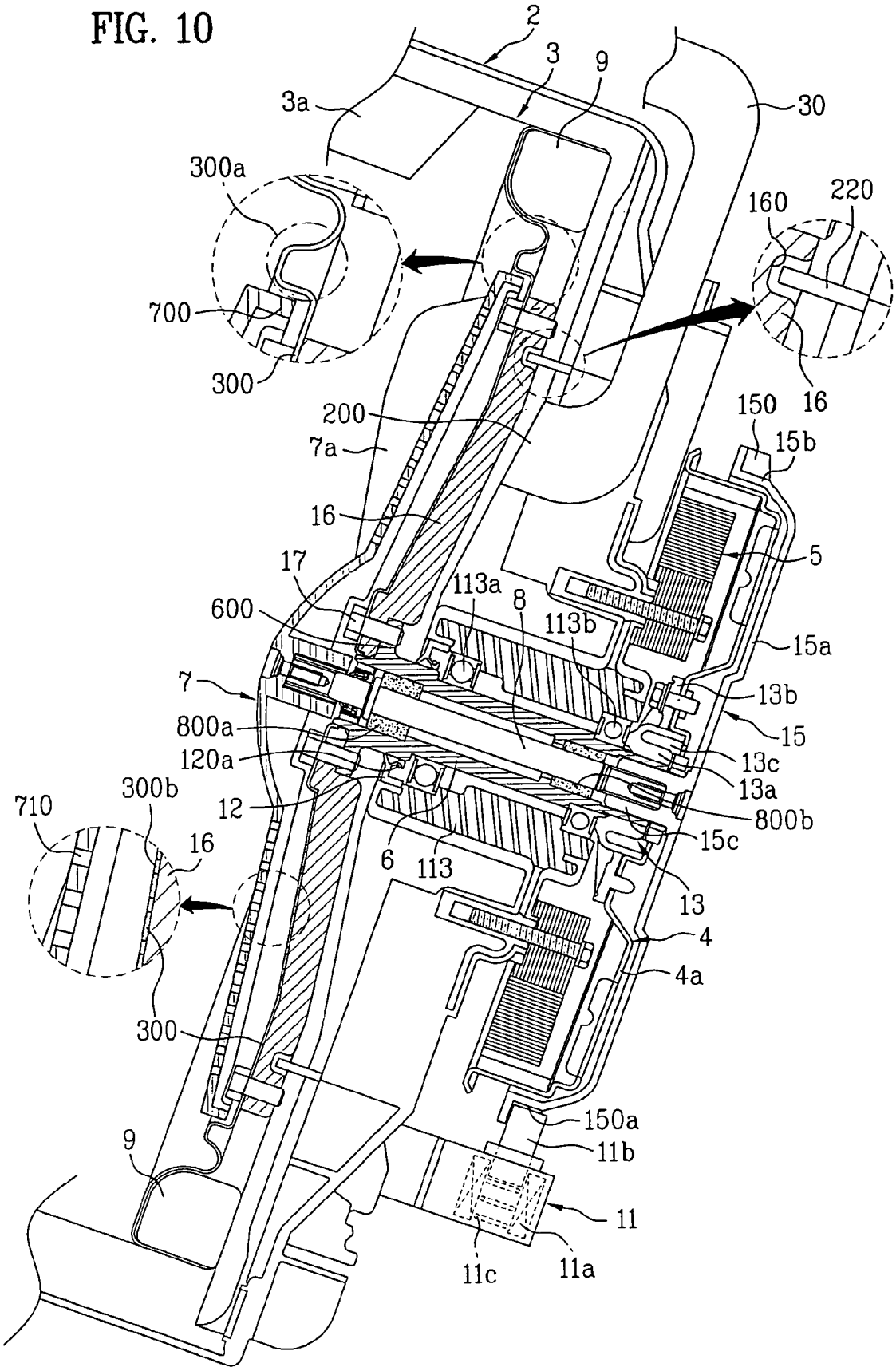
FIG. 10 illustrates a key part section, an enlarged view of the "A" part in FIG. 9, showing a pulsator in stationary.
Figure 11:
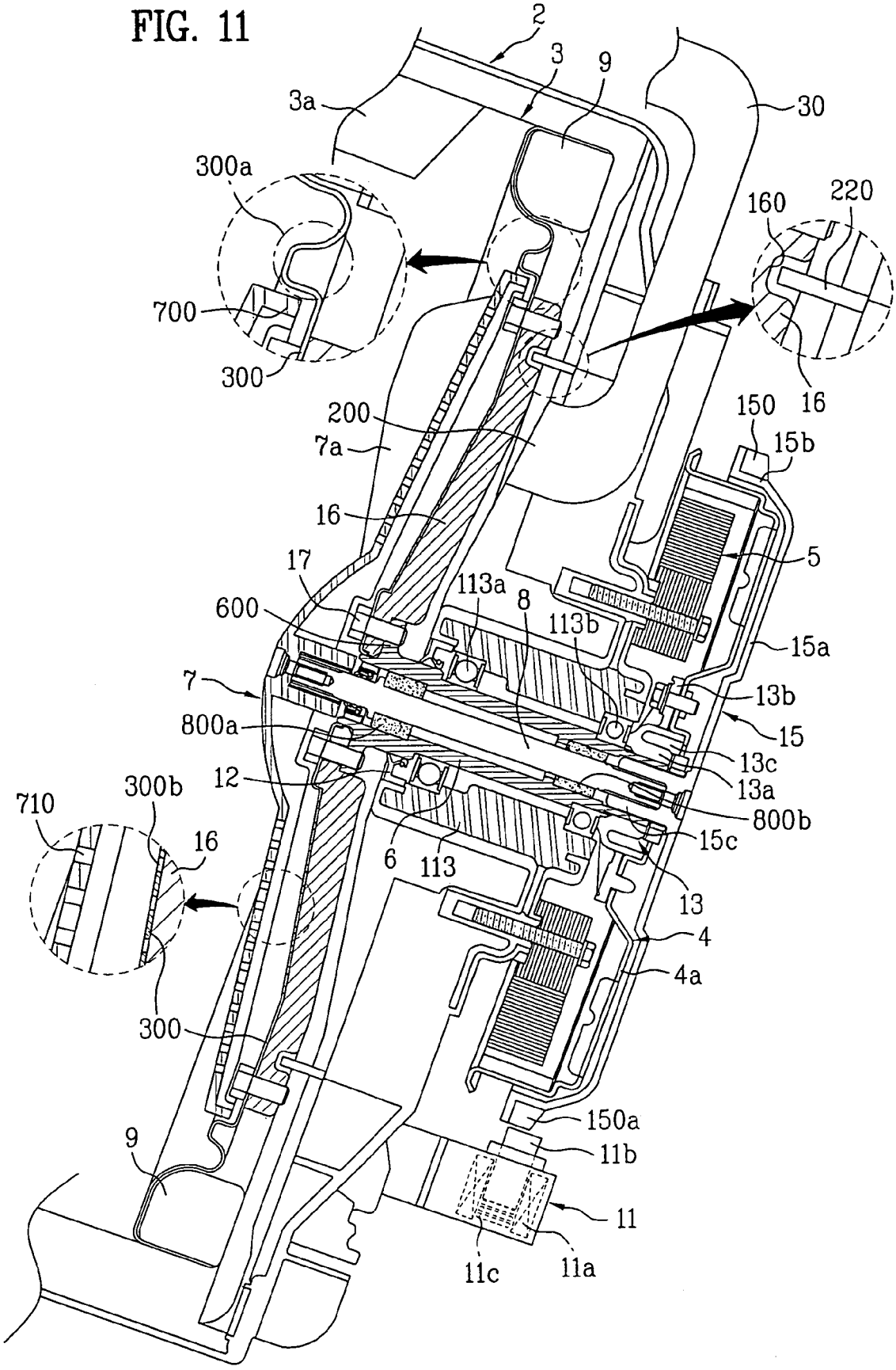
FIG. 11 illustrates a key part section, an enlarged view of the "A" part in FIG. 9, showing a pulsator in rotation.

FIG. 9 illustrates a longitudinal section of a drum type washing machine in accordance with a second preferred embodiment of the present invention schematically, FIG. 10 illustrates a key part section, an enlarged view of the "A" part in FIG. 9, showing a pulsator in stationary, and FIG. 11 illustrates a key part section, an enlarged view of the "A" part in FIG. 9, showing a pulsator in rotation.

Figure 12:
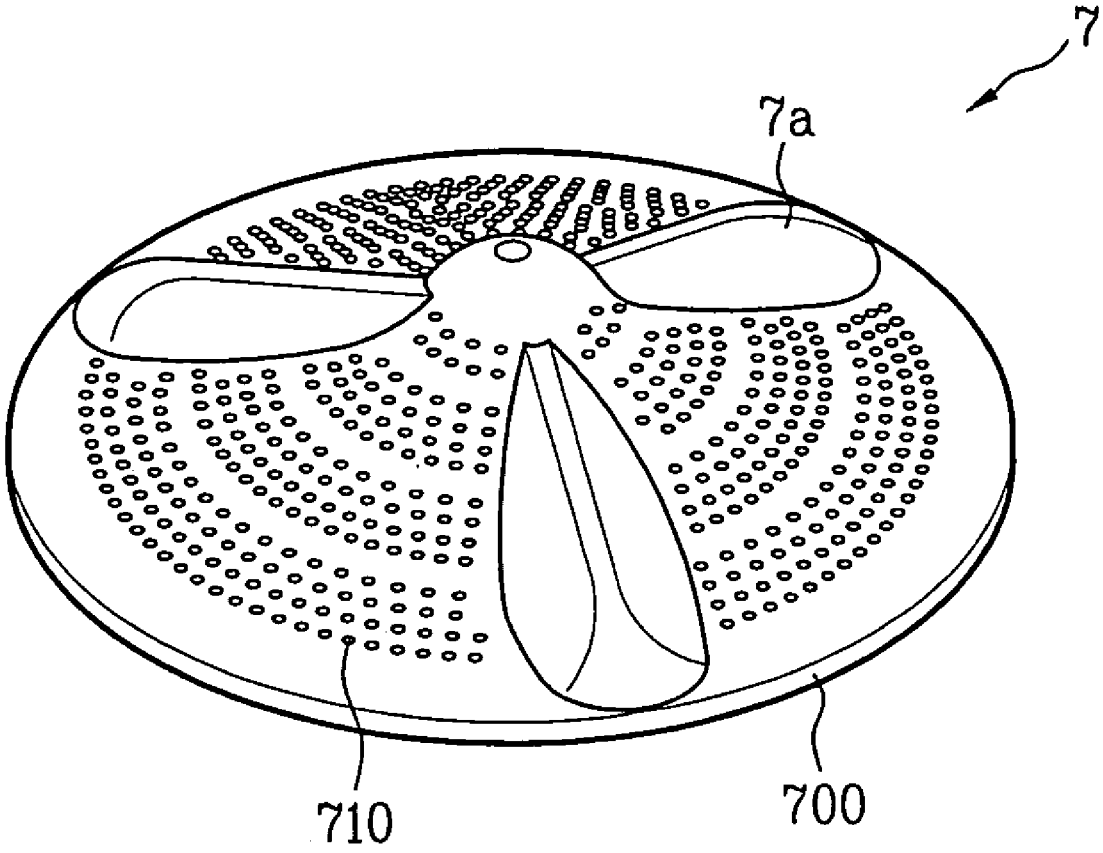
FIG. 12 illustrates a perspective view showing the pulsator in FIG. 9 as an example.

FIG. 12 illustrates a perspective view showing the pulsator in FIG. 9 as an example.

Meanwhile, the pulley and the rotor bushing in the second embodiment is identical to the first embodiment, in descriptions related thereto, FIGS. 6 to 8 will be referred to.

Referring to FIGS. 9 to 12, the drum type washing machine in accordance with a second preferred embodiment of the present invention includes a tub 2 of plastic having a wall portion for holding washing water and securing a driving unit thereto, a front side sloped upward at a predetermined angle from ground, a hot air inlet 200 in an upper side of a rear wall, and a hot air outlet 210 in a lower side of a front surface, a drum 3 rotatably mounted in the tub 2 having hot air pass through holes 300*b* in a rear wall, a drying duct 30 fixedly secured to one side of an upper side of the rear wall of the tub 2, having a heater 32 and a fan 31 mounted on an inside flow passage thereof for generating hot air, a condensing duct 40 for removing moist from hot air discharged through the hot air outlet 210 in a lower portion of the front of the tub 2, a hollow drum shaft 6 passed through the tub 2, and connected to the drum 3 inside of the tub 2 for transmission of driving power from a motor to the drum, bearings 113*a*, and 113*b* for supporting the hollow drum shaft 6, a bearing housing 113 of a sleeve shape for holding the bearings 113*a* and 113*b*, a stator 5 fixedly secured to the rear wall portion of the tub 2, a rotor 4 connected to a rear end of the drum shaft 6 to constitute a BLDC motor together with the stator 5, a pulsator 7 rotatably mounted in the drum 3, a pulsator shaft 8 mounted to pass through the hollow of the drum shaft 6, having a fore end connected to the pulsator 7, a pulley 15 in rear of the rotor 4 connected to a rear end of the pulsator shaft 8, and a braking device 11 for controlling rotation of the pulsator 7 in the drum 3 by braking/releasing the pulley 15.

Between the tub 2 and the drying duct 30, there is a thermal insulation plate 50 for preventing direct transmission of heat from the drying duct 30 to the tub, and on the rear wall 300 of the drum, there is a spider 16 fixedly secured thereto for supporting the drum 3.

The pulsator 7 has a plurality of small hot air supply holes 710 in a main surface (i.e., a surface) for serving as a flow passage for supplying hot air to an inside of the drum 3 during drying, and preventing damage to the laundry in washing.

The pulsator 7 has a rib 700 at an edge of an outside circumference bent toward the rear wall 300 of the drum, and there is a forming portion 300*a* in a shape in complementary to a shape of the rib 700, for cutting off an air flow toward an outer side of the pulsator 7.

Moreover, on an inside of the rear wall of the tub 2, there is a cutoff rib 220 projected toward the rear wall 300 of the drum, for preventing the hot air introduced thereto through the hot air inlet 200 of the tub 2 from escaping to an outer side of the drum, and the spider 16 has a groove 160 in a shape in complementary to a shape of the cutoff rib 220.

This is for preventing interference between the spider 16 of a tripod shape and the cutoff rib. Of course, a length of the cutoff rib may be formed differently, for not providing the groove 160 in the spider 16.

At a center of a rear side of the tub 2, there is the bearing housing 113 insert molded thereto as one unit therewith, having the front and rear bearings 113*a*, and 113*b* press fit therein for supporting the drum shaft 6 at a rear side of the drum 3.

The stator 5 is fastened to the rear wall of the tub 2 with fastening members, such as bolts.

In the meantime, the pulsator shaft 8 is supported on oiless bearings 800*a*, and 800*b* mounted on a front and a rear of the shaft, respectively.

Though it is preferable that the bearings 113*a* and 113*b*, supporting the hollow drum shaft 6, are mounted on a front side and a rear side of the shaft respectively for secure supporting of the shaft, there is no limit in a number of bearings.

In this instance, mounting the bearings 113*a* and 113*b* far from each other on the front side and rear side of the drum shaft 6 is favorable for secure supporting of the shaft.

It is favorable that, of the bearings 113*a* and 113*b* supporting the hollow drum shaft 6, the front side bearing 113*a* of the drum shaft 6 has a diameter grater than a diameter of the rear side bearing 113*b* for minimizing vibration of the drum 3 during spinning, and making strength higher.

In front of the front side bearing 113*a* of the drum shaft 6, there is a water seal 12 for preventing water leakage, having a spring therein for pressing the water seal 12 toward an outside circumferential surface of the drum shaft 6.

An outside of the water seal 12 is supported either on the bearing housing 113, or a shape of the rear wall of the tub as shown in FIGS. 10 and 11.

The braking device 11 includes a solenoid 11*a* secured to the tub 2, and a plunger 11*b* moving back and forth in the solenoid 11*a*, so that the plunger 11*b* brakes or releases the pulley 15 depending on electric turn on/off of the solenoid 11*a*, for braking/releasing rotation of the pulsator 7.

It is preferable that an elastic member, such as a compression spring 11*c*, is mounted in the solenoid 11*a*.

This is for the plunger 11*b* to be lead to a position of the holding recess 150*a* in the pulley 15 automatically if the pulley 15 coupled to the pulsator 7 rotates by an interference of the laundry following rotation of the drum 3 while the plunger 11*b* is kept abut with a surface around the holding recess 150*a* by an elastic force, even if the plunger 11*b* becomes to be positioned away from the holding recess 150 because the holding recess 150*a* in the pulley 15 is not aligned with the plunger 11*b* at the time the plunger 11*b* moves forward for braking the pulsator 7.

Different from above example in which the solenoid 11*a* is secured to the tub 2, the braking device of the solenoid 11*a* may be secured, not to the tub 2, but to other place, such as the cabinet 1, with the compression spring 11*c* and the plunger 11*b* provided therein, so that the back and forth movement of the plunger 11*b* following electric turn on/off of the solenoid 11*a* brakes/releases the pulley 15, thereby controlling braking/releasing rotation of the pulsator 7.

In the meantime, between the drum shaft 6 and the rotor 4, there is a rotor bushing 13 of plastic for engagement to the drum shaft 6 and the rotor frame 4*a* in a state the rotor bushing 13 is positioned in rear, or front of a rotor frame 4*a*.

The rotor bushing 13 includes an engagement portion 13*a* for placing in, and engagement with the drum shaft 6 at a center thereof, and a coupling portion 13*b* extended in a radial direction from a circumference of the engagement portion 13*a* for coupling with the rotor frame 4*a*.

It is preferable that the coupling portion 13*b* of the rotor bushing 13 includes a plurality of positioning projections formed as one body therewith and projected toward the rotor frame 4*a*, or a plurality of fastening holes 131*b* for fastening to the rotor frame 4*a* with bolts.

It is preferable that reinforcing ribs 13*c* are provided further at least one of the engagement portion 13*a* and the coupling portion 13*b* of the rotor busing 13 for reinforcement.

There are serration formed on an outside circumferential surface of a rear end portion of the drum shaft 6, and on an inside circumferential surface of a center of the engagement portion 13*a* of the rotor bushing opposite thereto, for engagement with each other.

In the meantime, on an outer side of the rear wall of the drum 3, there is a spider 16 secured thereto for supporting the rear wall 300 of the drum and reinforcing the strength, and at a front end portion of the drum shaft 6, there is a flange 600 in close contact with the spider 16, for fastening the drum rear wall 300, the spider 16, and the flange 600 of the drum shaft 6 with fastening members 17 passed therethrough.

The pulsator shaft 8 has serrations on opposite end portion for engagement with the pulsator 7 and the pulley 15, preferably each with an involute profile surface.

The pulley 15 includes a rear wall portion 15*a* covering the rear wall of the rotor frame 4*a*, a sidewall portion 15*b* for covering a sidewall of the rotor frame 4*a* of steel fabricated by pressing, an engagement portion 15*c* at a center of the rear wall portion 15*a* for engagement with the pulsator shaft 8, and the holding recess 150*a* in the pulley 15 at a portion covering the rotor frame 4*a* for being held by the braking device 11.

The engagement portion 15*c* of the pulley 15 has a boss shape projected from the pulley 15 such that the engagement portion 15*c* is positioned on an inside of a rear end of the drum shaft 6 at the time of assembly of the pulley 15 in an assembly line.

The drum shaft 6 is formed of an SM 45 group of material, or stainless steel, wherein if the drum shaft 6 is formed of an SM 45 group of material, a surface of the drum shaft 6 is plated with chrome Cr for reducing wear, and friction, and enhancing corrosion resistance. In this instance, the surface of the drum shaft 6 is plated with chrome Cr, entirely, or partially for reduction of cost. In this case, of the surface of the drum shaft 6, it is required to plate a sliding surface of the water seal 12 without fail.

In the meantime, it is favorable that the drum shaft 6 is formed of stainless steel even if it costs somewhat more, for reducing wear/friction of the slide surfaces of the water seal 12 and drum shaft 6 and securing corrosion resistance of the drum shaft 6, positively.

On a surface of the pulsator 7, there are washing fins 7*a* for increasing friction of the laundry by making the laundry, lifted up by the rotation of the drum 3 and fallen down, to hit the washing fins 7*a*, and moving the laundry back and forth within the drum 3.

In this instance, though it is preferable that a main surface (i.e., a surface) of the pulsator 7 and the washing fins 7*a* provided at regular intervals thereon are formed as one body, it is not necessarily so.

In the meantime, the washing fin 7*a* has at least one sloped surface in a radial, or circumferential direction.

The main surface of the pulsator 7 has a predetermined curvature, and an outside diameter around 50~80% of the inside diameter of the drum 3.

A maximum height 7*a* of the washing fin 7*a* of the pulsator 7 is 5~15% of the outside diameter of the pulsator.

Moreover, it is preferable that the drum 3 and the tub 2 are mounted such that axes thereof are tilted at 10~30° to ground, for convenience of introduction/taking out of laundry, and enhancing a washing effect. Also, the tilted angle of 10~30° range can prevent occurrence of excessive vibration.

If the tilted angle exceeds 30°, to make the drum 3 to rotate in a much tilted state, leading the laundry leaned on a rear side of the drum 3, a washing performance drops and an excessive vibration occurs in spinning due to entangling of the laundry.

Accordingly, taking this into account, it is preferable that the tilting angle of the tub 2 is below 30°.

In the meantime, the drum 3 has a plurality of lifters 3*a* on an inside circumferential surface for lifting up the laundry. There is a distance 'D' of approx. 30~90 mm between the lifter 3*a* and the washing fin of the pulsator 7, for preventing the laundry from being held between the lifter 3*a* and the pulsator 7 to hold rotation of the pulsator 7 and the drum 3.

In the meantime, it is preferable that auto-balancers 9 each filled with liquid, such as water, or salt water, are mounted on a front, and a rear of the drum 3, for reducing vibration in spinning.

In this instance, the auto-balancers 9 may be mounted on the inside of the front and the outside of the rear of the drum 3, or the inside of the front and the rear of the drum 3, respectively.

Moreover, the auto-balancer 9 may have a single fluid chamber, or more favorably, double, triple, or quadruple fluid chambers on concentric circles, separated between inner and outer fluid chambers, for preventing the fluid from moving between the fluid chambers.

It is favorable that the auto-balancer 9 has a height 'H' greater than a width 'W' for reducing vibration of the drum 3.

In the meantime, together with above, of course, between an inside surface of an upper surface of the cabinet 1 and an outside circumferential surface of an upper side of the tub 2, there may be hanging springs 2*a* for suspending the tub 2, and, between a lower side of an outside circumference of the tub 2 and a bottom surface of the cabinet 1, there may be dampers for damping vibration of the tub 2 in spinning.

The operation of the drum type washing machine in accordance with the second preferred embodiment of the present invention will be described.

The 10~30 degrees of tilting of the drum 3 and the tub 2 with reference to front sides ground thereof enables convenient introduction, and taking out of laundry.

That is, when it is intended to introduce or take out laundry into/from the drum 3, different from the related art drum type washing machine in which the user is required to stretch one hand in a state the user squats or bends, the drum type washing machine of the present invention enables easy handling of the laundry at the time of introduction or taking out laundry into/from the drum 3, owing to the tilted tub 2 and the drum 3.

Along with such convenience, the drum type washing machine of the present invention can improve the washing performance owing to the pulsator 7 mounted inside of the drum 3.

That is, though the related art drum type washing machine has a limitation in enhancing the washing performance since the washing is achieved only by lifting up and dropping down of the laundry with the lifters 3*a*, the drum type washing machine of the present invention can improve the washing performance significantly because the drum type washing machine of the present invention has the pulsator 7 mounted therein in addition to the tilted tub 2 and drum 3, to add impact between the pulsator 7 and the laundry to the action of the lifters 3*a*, and make the back and forth movement of the laundry more active owing to the tilting of the drum 3 and the shape of the pulsator 7.

In more detail, in a state the tub 2 and the drum 3 are tilted, and the pulsator shaft 8 is passed through the hollow drum shaft 6 and connected to the pulley 15 in rear of the motor, as the plunger 11*b* is placed in, or moved away from, the holding recess 150*a* in the pulley 150*a* by the action of the solenoid 11*a* and the compression spring 11*c* of the braking device 11 fixedly secured to the rear wall of the tub 2 or the like following control of power applied to the braking device, the pulley 15 is held or released. This holding or releasing of the pulley 15 implies that the pulsator 7 is held of freed.

According to this, as the pulsator 7 is held or freed to be rotatable in washing, varying movement of the laundry in the drum 3, the washing performance can be improved.

In the meantime, in spinning too, the plunger 11*b* may be placed in the holding recess 150*a* of the pulley 15, to hold the pulsator 7, or the plunger 11*b* may be moved away from the holding recess 150*a* of the pulley 15, to leave the pulsator 7 rotatable.

In the spinning, if the solenoid 11*a* is turned on to make the plunger 11*b* to move away from the holding recess 150*a* of the pulley 15, to leave the pulsator 7 to spin too if the drum 3 spins, the spinning of the pulsator 7 in this time is not a forced rotation like the drum by the direct driving force. That is, the pulsator 7 is rotated, not synchronized with a motor speed, but at a speed almost the same with the drum 3 as a rotation force of the drum is transmitted to the pulsator 7 through the laundry when the drum 3 rotates due to the laundry placed on the pulsator 7.

In the meantime, in drying, the hot air produced by the heater 32 in the drying duct 30 flows along the drying duct by forced blowing of the fan 31 and introduced into the hot air inlet 200 in the upper side of the rear wall.

In this instance, the cutoff rib 220 projected toward the rear wall 300 of the drum from an inside of rear wall of the tub 2 cuts off the hot air introduced through the hot air inlet 200 of the tub 2 from escaping toward an outer side of the drum.

Moreover, the groove 160 in the spider 16 in a shape in complementary to a shape of the cutoff rib 220 prevents interference between the cutoff rib 220 and the spider 16.

In the meantime, the hot air introduced through the hot air inlet 200 passes through the hot air pass through hole 300*b* in the rear wall of the drum 3, and is supplied to an inside of the drum 3 through the plurality of hot air supply holes 710 in the main surface of the pulsator 7 in an optimal arrangement.

In this instance, the rib 700 at the edge of the circumference of the outside diameter of the pulsator 7 bent toward the rear wall 300 of the drum, and the forming portion 300*a* in a shape on the rear wall 700 of the drum in complementary to the shape of the rib 700 at the edge of the pulsator 7 cut off air flow to an outer side of the pulsator 7 effectively, thereby enabling concentration of the hot air on a center portion of the drum 3.

The high temperature, high humid air, having substantially center blown along an axis of the drum and dried the laundry, is discharged through the hot air outlet 210 in a lower side of the front of the tub 2, introduced toward the condensing duct 40, and turns to a low temperature, low humid air by condensing of the cooling water supplied through a condensing water tube 60 as the high temperature, high humid air passes the condensing water.

Then, the air introduced toward the drying duct 30 recirculates as the air passes through a flow passage of the duct, is heated by the heater therein, and supplied to the drum 3 again. As such a circulating process is repeated, drying of the laundry is progressed.

Thus, the application of a new drying system in which the hot air is center blown along the axis of the drum 3 enables the drum type washing machine of the embodiment to improve drying efficiency and drying performance as the air supplied into the drum 3 can reaches deep into the inside of the drum, to make uniform drying of the laundry.

That is, the hot air is introduced from the drying duct 30 into the drum 3 through an upper portion of the rear of the tub 2, flows through the drum 3, and discharged through a lower portion of the front of the tub 2. Accordingly, the hot air is supplied deep into the inside of the drum 3 uniformly, to improve the drying efficiency, and drying performance.

Different from a related art drum type washing machine and dryer, the connection of the drying duct 30 to the tub 2 resolves the problem of wear and tear of the gasket 20.

Moreover, the connection of the drying duct 30 to the tub 2 makes an upper side and a lower side of the gasket 20 exact symmetry, enabling the gasket 20 to absorb vibration of the tub 2, uniformly.

Furthermore, since the hot air is introduced into the drum 3 through the tub 2 without passing through the gasket 20, different from the related art, the problem of unnecessary heating of the door is resolved.

The securing of the drying duct 30 and the condensing duct 40 to the tub 2 enables to dispense with a separate flexible member at a connection portion between the drying duct 30 and the tub 2 like the related art.

The drying duct 30 attached to the tub 2 also serves as a balancer weight, to improve a balance sustaining capability of the tub.

Moreover, the effective arrangement of the hot air pass through holes 300*b* in the rear wall 300 of the drum can maximize a flow rate of the hot air introduced into the drum 3 while strength of the drum 3.

In the meantime, along with the improvement of the washing and the drying performance, the drum type washing machine of the present invention can reduce system vibration caused by an eccentric load in the drum 3 effectively in spinning by providing the auto-balancers 9 to the front and the rear of an inside of the drum 3 for balancing the drum by means of fluid separate from balance weights mounted on the tub 2.

Particularly, though the drum type washing machine of the embodiment is liable to have greater vibration at a rear side than the related art due to the tilted tub 2 and the drum 3, the attachment of the auto-balancers 9 to the inside or outside of rear of the drum 3 enables effective reduction of vibration of the rear side.

Moreover, as described before, the tilted tub 2 also requires the drum 3 in the tub 2 to be tilted, to consume less washing water filled in the drum 3 in washing.

For an example, owing to the tilted drum 3, washing water leans on a rear side of the drum 3 partially, and to carry out the washing after filling the washing water only just to put the laundry gathered on the rear side under the washing water.

In the meantime, the placement of the engagement portion 15*c* of the pulley 15 in the drum shaft 6 in assembly of the pulley 15 shortens a total length of the drum type washing machine.

That is, if the engagement portion 15*c* of the pulley 15 can not be placed in the drum shaft 6 in a tilted state, though the total length becomes longer, to reduce the capacity of the drum type washing machine, the placement of the engagement portion 15*c* of the pulley 15 in the drum shaft 6 enables to reduce the total length, leading to increase the washing capacity, relatively.

In the meantime, a control process and operation of the pulley 15 will be described in washing or drying of the drum type washing machine in accordance with the preferred embodiment of the present invention.

A process for washing or drying by rotating the drum 3 in a state the pulsator 7 is stationary will be described with reference to FIG. 10.

Referring to FIG. 10, if the plunger 11*b* moves forward to position in the holding recess 150*a* of the pulley 15, the pulley 15 can rotate no more, to hold the pulsator 7 in the drum 3 too.

In this state, if power is applied for washing, the rotor 4 rotates by electro-magnetic interaction with the stator 5, to rotate the drum 3 coupled to the rotor 4 with a shaft.

In this instance, the drum 3 may rotate in left/right directions alternately under the control of a microcomputer (not shown), and the pulsator 7 is stationary.

According to this, the washing is performed as the laundry is lifted by the plurality of lifters 3*a* in the drum 3 and dropped by gravity, when a portion of the laundry hits the pulsator 7 and the washing fin 7*a* to move forward because the drum 3 is tilted.

Particularly, the washing machine of the present invention has a greater back and forth movement of the laundry dropped after lifted up by the lifters 3*a* than the related art owing to the central projection of the washing fins 7*a* and the pulsator 7. That is, the sloped surface of the washing fins 7*a*, the main surface curvature of the pulsator 7, and the tilted angle, and so on cause positional change of the laundry.

Moreover, since the drum 3 rotates in a tilted state, and the pulsator 7 is stationary, a speed difference between the rotating drum 3 and the stationary pulsator 7 causes irregular and various forms of laundry movement and circulation of the washing water.

In this instance, the washing water circulation spreads the laundry gathered on a rear side of the drum 3 to various directions again, to help uniform washing of the laundry.

That is, in washing, the water circulation caused by collision between the washing water and the pulsator 7, and impact between the laundry and the pulsator improves a washing capability and rinsing capability of the laundry, substantially.

Different from above, a washing and drying in a state the pulsator 7 is rotatable as the braking on the pulley 15 is released will be described with reference to FIG. 11.

Referring to FIG. 11, if power is applied to the solenoid 11*a* to move the plunger 11*b* backward, while compressing the compression spring 11*c*, the plunger 11*b* moves away from the holding recess 150*a* of the pulley 15, leaving the pulley 15, as well as the pulsator 7 rotatable.

Under this state, if power is applied for washing, the rotor rotates by the electro-magnetic interaction with the stator 5, to rotate the drum 3 coupled to the rotor 4 with a shaft.

In this instance, as described before, the drum 3 can rotate in left/right directions alternately at predetermined intervals, and the pulsator 7 rotates in a left, or right direction under the interference of the laundry and the washing water circulating in the drum when the drum 3 rotates.

Accordingly, in washing the laundry by lifting the laundry with a plurality of lifters 3*a* on an inside of the drum 3 and dropping the laundry by gravity, since the drum 3 is tilted, a portion of the laundry collides onto the rotating pulsator 7.

The laundry 7 collided onto the pulsator 7 moves forward.

That is, alike a previous description, in this case too, the drum type washing machine of the present invention causes a positional change of the laundry owing to the sloped surface of the washing fin 7*a*, the main surface curvature of the pulsator 7, and the tilted angle, to increase back and forth movement of the laundry compared to the related art drum type washing machine in which the laundry is simply lifted up by the lifters 3*a* and dropped.

Along with this, because the pulsator 7 rotates not forcibly at a fixed speed though the pulsator 7 is in a rotatable state, there is a speed difference between the drum 3 and the pulsator 7, to cause irregular and various forms laundry movement and washing water circulation in this time too.

That is, even if the relative speed difference is small compared to the state the pulsator 7 is stationary, there is a relative speed difference between the drum 3 and the pulsator 7, which helps the movement of the laundry, that contributes to improvement of the washing capability and the rinsing capability.

In short, the drum type washing machine of the present invention can perform washing by using a relatively great speed difference in a state the pulsator 7 is held to be stationary, or by using a relatively small speed difference in a state the pulsator 7 is released to rotate freely.

Moreover, in washing, the washing may be performed by controlling the alternating time period of the drum 3 to be short in which the laundry does not drop in a state the pulsator 7 is held or released.

In the meantime, the drum type washing machine of the present invention can perform spinning or drying in a state the pulsator 7 is fixed unable to rotate, or freed to rotate as it likes by controlling the braking device 11.

The present invention is not limited to above embodiments, but variations and modifications in a variety of forms are possible as far as the variations and modifications do not depart from a scope of technical aspect of the present invention.

For an example, a small sized pulsator may be rotatably mounted on an inside circumference of the drum 3.

INDUSTRIAL APPLICABILITY

As has been described, the drum type washing machine in accordance with first, or second preferred embodiment of the present invention can improves product reliability of the user as the tilted tub enables easy introduction and taking out of the laundry, and to reduce consumption of water in washing.

Particularly, the rotation of the drum in a tilted state, and the provision of pulsator inside of the drum vary movement of the laundry and water circulation within the drum, which improves a washing performance.

That is, the positional change of the laundry caused by the sloped surface of the washing fins and the slope of the main surface of the pulsator makes back and forth movements of the laundry more active than the related art in which the laundry is merely lifted up by the lifters and dropped, to vary the movements of the laundry, and the water circulation, which improves a washing performance.

Moreover, the application of a new drying system in which hot air is center blown along an axis of the drum permits the air to penetrate deep into an inside of the drum, to improve a drying efficiency, and a drying performance.

The connection of the drying duct to the tub, making the gasket arranged in an exact symmetry permits uniform absorption of vibration of the tub, and, different from the related art, resolves the problem of unnecessary heating of the door.

The drying duct also serving as a balance weight improves a balance sustaining capability of the tub.

In the meantime, along with the improvement of the washing and drying performance, the provision of auto-balancers to a front and a rear of the drum for maintaining balance of the drum by means of fluid in addition to the balance weights mounted on the tub permits effective reduction of system vibration caused by en eccentric load in the drum during spinning.

The invention claimed is:

1. A drum type washing machine comprising:

a tub of plastic having a wall portion for holding washing water and securing a driving unit thereto, and a front side sloped upward at a predetermined angle from ground;

a drum rotatably mounted in the tub;

a hollow drum shaft passed through the tub, and connected to the drum inside of the tub for transmission of driving power from a motor to the drum;

at least one bearing for supporting the hollow drum shaft;

a stator fixedly secured to the rear wall portion of the tub;

a rotor connected to a rear end of the drum shaft to constitute a motor together with the stator;

a pulsator rotatably mounted in the drum;

a pulsator shaft mounted to pass through the hollow drum shaft, having a fore end connected to the pulsator; and a pulsator control means for braking/releasing rotation of the pulsator, wherein the pulsator control means includes;

a pulley in rear of the rotor connected to a rear end of the pulsator shaft, for controlling rotation of the pulsator, and a braking device for controlling rotation of the pulsator in the drum by braking/releasing the pulley.

2. The drum type washing machine as claimed in claim 1, wherein the pulsator shaft is supported on oilless bearings on a front side and a rear side thereof.

3. The drum type washing machine as claimed in claim 1, wherein the at least one bearing for supporting the hollow drum shaft includes one on a front side, and the other one on a rear side of the drum shaft.

4. The drum type washing machine as claimed in claim 3, wherein, of the bearings supporting the hollow drum shaft, the front side bearing of the drum shaft has a diameter greater than a diameter of the rear side bearing for minimizing vibration of the drum during spinning, and making strength higher.

5. The drum type washing machine as claimed in claim 3, further comprising a water seal in front of the front side bearing of the drum shaft, for preventing water from leaking.

6. The drum type washing machine as claimed in claim 5, wherein the water seal includes a spring mounted therein for compressing the water seal.

7. The drum type washing machine as claimed in claim 5, wherein an outside portion of the water seal is supported on a bearing housing, or a shape of the rear wall of the tub.

8. The drum type washing machine as claimed in claim 1, wherein the braking device includes;

a solenoid secured to the tub, a plunger moving back and forth in the solenoid, and a compression spring in the solenoid for providing force to move the plunger forward, so that the plunger brakes or releases the pulley depending on electric turn on/off of the solenoid, for braking/releasing rotation of the pulsator.

9. The drum type washing machine as claimed in claim 1, wherein the braking device includes;

a solenoid secured to a cabinet which encloses the tub, a plunger moving back and forth in the solenoid, and a compression spring in the solenoid for providing force to move the plunger forward, so that the plunger brakes or releases the pulley depending on electric turn on/off of the solenoid, for braking/releasing rotation of the pulsator.

10. The drum type washing machine as claimed in claim 1, further comprising a rotor bushing between the drum shaft and the rotor.

11. The drum type washing machine as claimed in claim 10, wherein the rotor bushing couples to the drum shaft and the rotor frame in a state the rotor bushing is positioned in rear, or front of a rotor frame.

12. The drum type washing machine as claimed in claim 11, wherein the rotor bushing includes;

an engagement portion at a center thereof for placing in, and engagement with the drum shaft, and a coupling portion extended in a radial direction from a circumference of the engagement portion for coupling with the rotor frame.

13. The drum type washing machine as claimed in claim 12, wherein the coupling portion of the rotor bushing includes positioning projections projected toward the rotor frame as one body.

14. The drum type washing machine as claimed in claim 13, wherein the coupling portion of the rotor bushing includes fastening pass through holes for fastening to the rotor frame with bolts.

15. The drum type washing machine as claimed in claim 13, wherein the rotor bushing further includes a reinforcing rib which is provided at least one of the engagement portion or the coupling portion.

16. The drum type washing machine as claimed in claim 13, wherein the drum shaft includes a serration on an outside circumferential surface of a rear end portion of the drum shaft, and the rotor bushing includes a serration on an inside circumferential surface of a center of the engagement portion of the rotor bushing opposite to the serration of the drum shaft, for engagement with each other.

17. The drum type washing machine as claimed in claim 13, wherein the rotor bushing is formed of plastic.

18. The drum type washing machine as claimed in claim 1, further comprising:

a spider secured the rear wall of the drum for supporting the rear wall of the drum and reinforcing the strength, and a flange at a front end portion of the drum shaft in close contact with the spider, for fastening the drum rear wall, the spider, and the flange of the drum shaft with fastening members passed therethrough, together.

19. The drum type washing machine as claimed in claim 1, wherein the pulsator shaft includes serrations at opposite ends for engagement with the pulsator and the pulley.

20. The drum type washing machine as claimed in claim 19, wherein the serration includes an involute profile surface.

21. The drum type washing machine as claimed in claim 1, wherein the motor is a BLDC motor.

22. The drum type washing machine as claimed in claim 8, wherein the pulley includes;

a portion for covering the rear wall of the rotor frame, a portion for covering a sidewall of the rotor frame, an engagement portion at a center of the rear wall portion 15*a* for engagement with the pulsator shaft, and a holding recess in the pulley at a portion covering the rotor frame for being held by the braking device.

23. The drum type washing machine as claimed in claim 22, wherein the engagement portion of the pulley includes a projected boss shape for placing, and being positioned inside of the rear end of the drum shaft in assembly.

24. The drum type washing machine as claimed in claim 5, wherein the drum shaft includes a surface plated with chrome for reducing wear, and friction, and enhancing corrosion resistance of the drum shaft.

25. The drum type washing machine as claimed in claim 24, wherein the chrome is plated at least on a surface sliding with the water seal or the like of the drum shaft.

26. The drum type washing machine as claimed in claim 5, wherein the drum shaft is formed of stainless steel for reducing wear, and friction of a sliding surface between the water seal and the drum shaft, and enhancing corrosion resistance of the drum shaft.

27. The drum type washing machine as claimed in claim 1, further comprising washing fins for increasing friction of the laundry by making the laundry to be hit the washing fins when the laundry is lifted up by the rotation of the drum and fallen down.

28. The drum type washing machine as claimed in claim 27, wherein the washing fins at regular intervals on the main surface of the pulsator are formed as one body with the main surface of the pulsator.

29. The drum type washing machine as claimed in claim 27, wherein the washing fin includes at least one sloped surface with respect to a radial direction, or a circumferential direction of the pulsator.

30. The drum type washing machine as claimed in claim 27, wherein the main surface of the pulsator has a predetermined curvature.

31. The drum type washing machine as claimed in claim 27, wherein the washing fins of the pulsator has a maximum height of 5~15% of an outside diameter of the pulsator.

32. The drum type washing machine as claimed in claim 1, wherein the pulsator has an outside diameter of around 50~80% of an inside diameter of the drum.

33. The drum type washing machine as claimed in claim 1, wherein the drum and the tub have axes tilted by 10~30° from ground.

34. The drum type washing machine as claimed in claim 33, further comprising a pulsator rotatably mounted on an inside circumferential surface of the drum.

35. The drum type washing machine as claimed in claim 1, further comprising a plurality of lifters on the inside circumferential surface of the drum for lifting up the laundry during washing, the lifters spaced away from the pulsator by approx. 30~90 mm.

36. The drum type washing machine as claimed in claim 1, further comprising auto-balancers mounted on a front and a rear of the drum for reducing vibration in spinning, respectively.

37. The drum type washing machine as claimed in claim 36, wherein the auto-balancer has a ring shape with a single fluid chamber.

38. The drum type washing machine as claimed in claim 36, wherein the auto-balancers are arranged to form concentric circles, at least double structured.

39. The drum type washing machine as claimed in claim 38, wherein the auto-balancer has a height greater than a width.

40. A drum type washing machine comprising:

a tub of plastic having a wall portion for holding washing water and securing a driving unit thereto, and a front side sloped upward at a predetermined angle from ground;

a drum rotatably mounted in the tub;

lifters on an inside circumferential surface of the drum;

a hollow drum shaft passed through the tub, and connected to the drum inside of the tub for transmission of driving power from a motor to the drum;

at least one bearing for supporting the hollow drum shaft;

a sleeve shaped bearing housing for supporting the bearing;

a stator fixedly secured to the rear wall portion of the tub;

a rotor bushing of an insulating material secured to a rear end of the drum shaft;

a rotor secured to the rotor bushing for transmission of driving force to the drum shaft through the rotor bushing;

a rotor secured to a rear end of the drum shaft to constitute a BLDC motor together with the stator;

a pulsator rotatably mounted on an inside of the drum, having curved shape of washing fins on a main surface thereof;

a pulsator shaft mounted to pass through the hollow of the drum shaft, having a fore end connected to the pulsator;

a pulley positioned in rear of the rotor, and coupled to a rear end of the pulsator shaft, for controlling rotation of the pulsator; and a braking device including;

a solenoid secured to the tub, a plunger moving back and forth in the solenoid, so that the plunger brakes or releases the pulley depending on electric turn on/off of the solenoid, for braking/releasing rotation of the pulsator.

41. A method for controlling a tilted drum type washing machine, in which rotation of a pulsator in a drum is controlled by braking/releasing a pulsator rotation control pulley, comprising the steps of:

performing washing in a state the pulsator is held; and performing washing in a state the pulsator is released to rotate freely.

42. The method as claimed in claim 41, further comprising the step of performing soft washing by controlling an alternating time period of the drum to be a short time in which the laundry does not drop in a state the pulsator is held or released in washing.

43. The method as claimed in claim 41, further comprising the steps of:

performing spinning in a state the pulsator is held; and performing spinning in a state the pulsator is released to rotate, freely.

* * * * *